US009322610B2

(12) United States Patent
Zajk et al.

(10) Patent No.: US 9,322,610 B2
(45) Date of Patent: Apr. 26, 2016

(54) FIREARM WITH REPLACEABLE GRIP

(71) Applicant: Sturm, Ruger & Company, Inc., Southport, CT (US)

(72) Inventors: Joseph J. Zajk, Prescott, AZ (US); Sam Vavro, Longmont, CO (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 14/531,013

(22) Filed: Nov. 3, 2014

(65) Prior Publication Data

US 2015/0121738 A1 May 7, 2015

Related U.S. Application Data

(60) Provisional application No. 61/899,031, filed on Nov. 1, 2013.

(51) Int. Cl.
*F41C 23/16* (2006.01)
*F41A 11/02* (2006.01)

(52) U.S. Cl.
CPC ..... *F41C 23/16* (2013.01); *F41A 11/02* (2013.01)

(58) Field of Classification Search
CPC ..... F41C 23/16
USPC ..... 42/71.02, 72, 90
See application file for complete search history.

(56) References Cited

U.S. PATENT DOCUMENTS

| | | | |
|---|---|---|---|
| 6,112,446 | A | 9/2000 | Foerster et al. |
| 6,886,286 | B2 | 5/2005 | Dowding |
| 7,587,852 | B1 | 9/2009 | Harms |
| 7,937,874 | B2 | 5/2011 | Roth |
| 2006/0150467 | A1 | 7/2006 | Poulin et al. |
| 2009/0313873 | A1 | 12/2009 | Roth |
| 2010/0154279 | A1 | 6/2010 | Polyzos et al. |
| 2010/0212202 | A1 | 8/2010 | Roth |

OTHER PUBLICATIONS

Corresponding International Search Report and Written Opinion for PCT/US2014/063640 dated Feb. 13, 2015.

*Primary Examiner* — Reginald Tillman, Jr.
(74) *Attorney, Agent, or Firm* — The Belles Group, P.C.

(57) ABSTRACT

A firearm with replaceable grip in one embodiment includes a grip frame, a grip, and a rotary camlock mechanism configured to lock and unlock the grip from the grip frame. The camlock mechanism may be rotated between locked and unlocked positions preventing or enabling removal of the grip from the grip frame. In one embodiment, the camlock mechanism includes a movable blocking surface engageable with the grip to block its removal. The camlock mechanism in one configuration may comprise a rotatable locking cam that defines the blocking surface. A camtrack may be provided to convert rotary motion of the cam into linear displacement relative to the grip frame for selectively projecting or retracting the blocking surface relative to the frame.

22 Claims, 28 Drawing Sheets

ASSEMBLY POSITION

UNLOCKED POSITION

LOCKED POSITION

FIREARM WITH REPLACEABLE GRIP

CROSS-REFERENCE TO RELATED PATENT APPLICATIONS

The present application claims the benefit of U.S. Provisional Patent Application Ser. No. 61/899,031 filed Nov. 1, 2013, the entirety of which is incorporated herein by reference.

BACKGROUND OF THE INVENTION

The present invention generally relates to firearms, and more particularly to a user replaceable and interchangeable firearm grip.

Firearms including auto-loading pistols traditionally are offered with a variety of grip styles. The grips may differ in characteristics such as size, shape, material, and surface textures to suit manufacturer and/or user preferences. Grips may sometimes be attached to the grip frame of the firearm with threaded fasteners and other parts which are easily lost in the field, and may make a grip exchange a cumbersome process.

An improved user-replaceable grip is desired.

SUMMARY OF THE INVENTION

A user-replaceable firearm grip mounting system is disclosed that provides a mechanically simple and quick grip exchange. The system includes a firearm having a grip frame and grip detachably mountable to the frame. A rotatable camlock mechanism is provided which operably locks and unlocks the grip from the grip frame, thereby allowing rapid exchange of different grips. The camlock mechanism may remain mounted to the grip frame during the grip exchange to eliminate or minimize the possibility of losing parts in the field. In one embodiment, the firearm may be a pistol; however, the camlock mechanism disclosed is readily adaptable to any type firearm or non-firearm which includes a pistol-type grip. Accordingly, the invention is not limited to pistols or firearms alone.

In one embodiment, a firearm with replaceable grip includes a grip frame defining a grip mounting axis, a grip configured for mounting on the grip frame, and a rotary camlock mechanism configured and operable to lock and unlock the grip from the grip frame. The camlock mechanism is rotationally movable between a first locked position preventing removal of the grip from the grip frame and a second unlocked position allowing removal of the grip from the grip frame. The camlock mechanism includes a blocking surface moveable into and out of engagement with an abutment surface on the grip to prevent removal of the grip from the grip frame. In one configuration, the camlock mechanism comprises a rotatable locking cam.

In another embodiment, a firearm with replaceable grip system includes a grip frame defining a grip mounting axis, a grip removably mounted on the grip frame, an abutment surface formed on the grip, and a rotary locking cam rotatably received in a complementary configured open receptacle in the grip frame. The locking cam includes a blocking surface movable between a projecting locked position and a retracted unlocked position. The locking cam further includes an inclined cam track configured to engage the grip frame for converting rotational movement of the locking cam into linear movement with respect to the receptacle. Rotating the locking cam in a first direction moves the blocking surface into alignment with the abutment surface forming the locked position that prevents removal of the grip from the grip frame, and rotating the locking cam in a second direction removes the blocking surface from alignment with the abutment surface forming the unlocked position that allows removal of the grip from the grip frame. In one configuration, the locking cam has a cylindrical shape with circumferentially extending sidewalls.

A method for mounting a replaceable grip on a firearm is provided. The method includes: providing a grip frame including a grip mounting axis and a rotary locking cam rotated to an unlocked position; providing a grip including an abutment surface; positioning the grip on the grip frame in a removal position wherein the abutment surface is located in a first axial position along the grip mounting axis; sliding the grip on the grip frame to a mounting position wherein the abutment surface is located in a second axial position along the grip mounting axis; and rotating the locking cam from the unlocked position to a locked position thereby moving a blocking surface on the locking cam into axial alignment with the abutment surface of the grip between the first and second axial positions; wherein the grip is not removable from the grip frame when the locking cam is in the locked position.

BRIEF DESCRIPTION OF THE DRAWINGS

The features of the preferred embodiments will be described with reference to the following drawings where like elements are labeled similarly, and in which.

Figure 1:
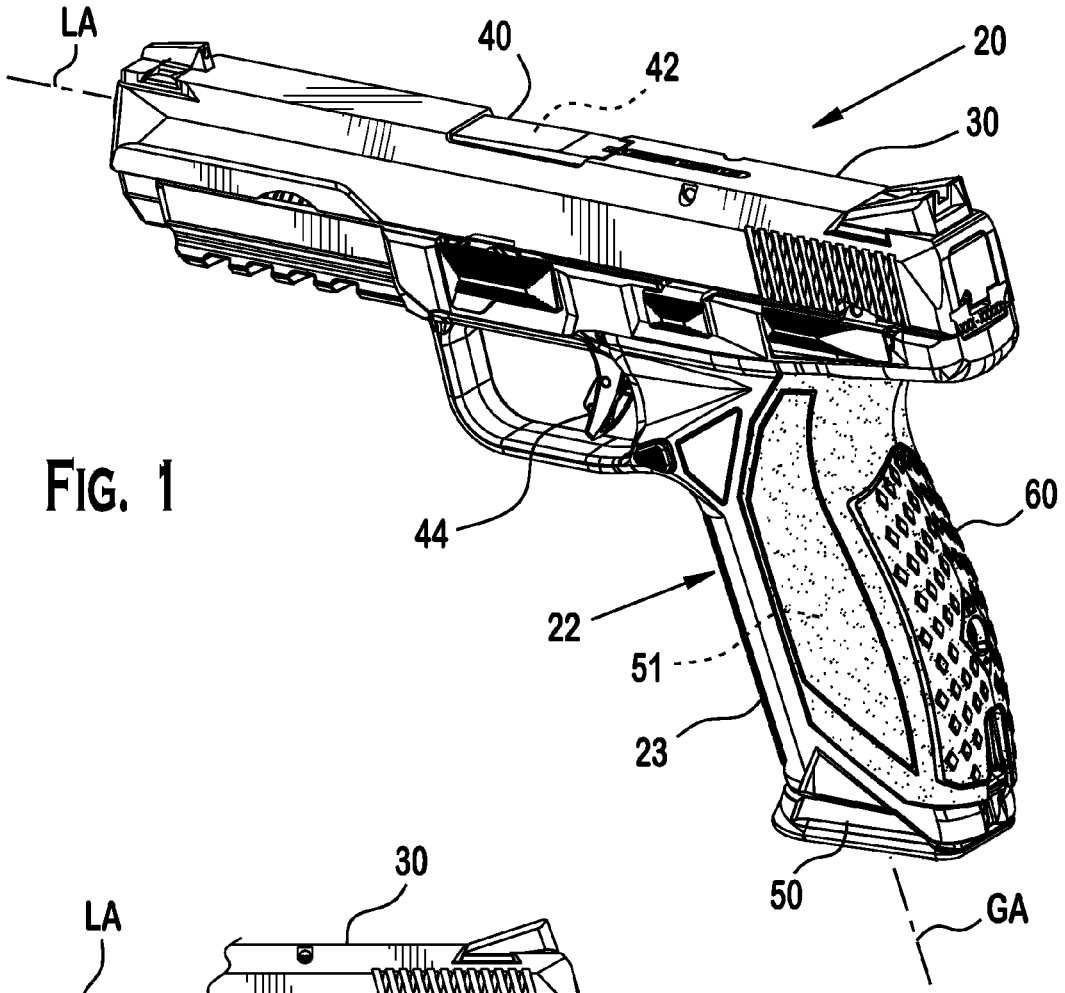
FIG. 1 is a left side perspective view of a firearm with grip mounting system according to the present disclosure.

All drawing shown herein are schematic and not to scale. Parts given a reference number in one figure may be considered to be the same parts where they appear in other figures without a reference number for brevity unless specifically labeled with a different part number and described herein. Reference to whole numerical figure numbers having related figures with an alphabetical suffix shall be construed as a reference to all the figures beginning with that number unless specifically noted otherwise.

DETAILED DESCRIPTION

The features and benefits of the invention are illustrated and described herein by reference to preferred but non-limiting exemplary embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

An exemplary firearm incorporating an embodiment of a replaceable grip system according to principles of the present invention will now be described with reference to a semi-automatic pistol. The principles and features of the embodiments disclosed herein, however, may be embodied with equal benefit in other types of hand-held firearms or weapons including without limitation rifles with pistol-type grips, revolvers, grenade launchers, etc. Accordingly, the invention is not limited in its applicability or scope to pistols alone as described herein. The replaceable grip system is also readily adaptable for use in non-firearm related applications such as without limitation power hand tools (e.g. drills, impact drivers, nail guns, etc.) which may benefit from the ability to easily replace hand grips used in such devices to suit different user and/or manufacturer preferences. The replaceable grip allows end users to select grips with different girths to match variations in hand size for comfort and/or other personal preferences such as grip texture, appearance, color, material, etc.

Figure 2:
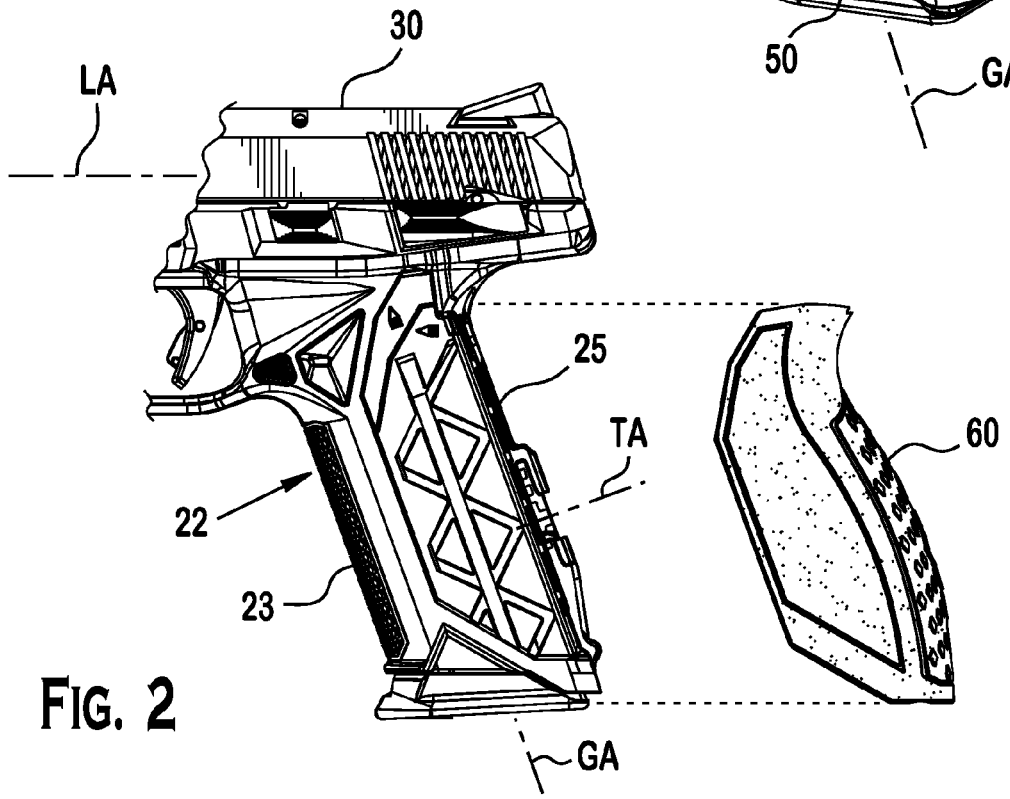
FIG. 2 is side elevation view showing the grip removed from the grip frame.
Figure 3:
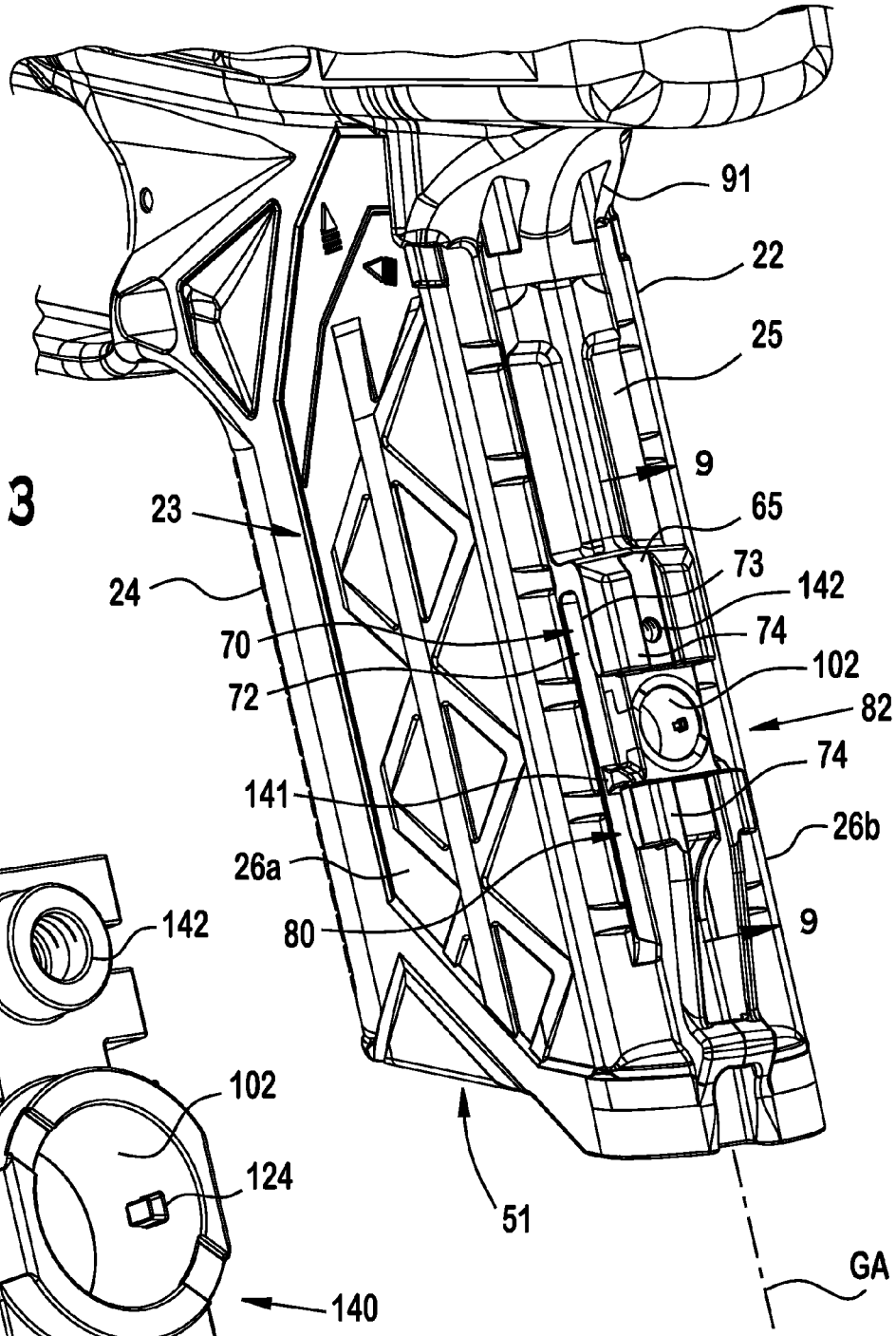
FIG. 3 is a rear perspective view of the grip frame.

FIGS. 1-32 depict a firearm grip mounting system and component parts according to the present disclosure. FIGS. 1-3 specifically illustrate a full view and rear portion thereof of a pistol embodying the present grip frame and replaceable grip assembly. The pistol 20 includes a grip frame 22 having a horizontally elongated top portion supporting a reciprocating slide 30, a barrel 40 defining an axial bullet pathway disposed inside the slide with rear chamber 42 therein for holding an ammunition cartridge, and a trigger mechanism 44 supported by the frame for firing the pistol. Barrel 40 defines a longitudinal axis LA of the pistol.

The grip frame 22 includes a vertically elongated rear gripping or grasping portion 23 configured for grasping by a user. The grasping portion 23 includes a front wall 24, opposing rear wall 25, and opposing lateral sidewalls 26*a* (left), 26*b* (right). The grasping portion 23 defines a grip mounting axis GA and a transverse axis TA oriented perpendicular to axis GA. Grip mounting axis is oriented transversely to longitudinal axis LA and is oriented substantially parallel to the front and rear walls 24, 25 of the grasping portion 23. Grip mounting axis GA defines an axial grip direction and transverse axis TA defines a transverse grip direction.

The walls of the grasping portion 23 further define a hollow downwardly open magazine well 51 that slideably and insertably receives a removable magazine 50 configured for holding a plurality of ammunition cartridges. The grasping portion 23 of the grip frame 22 may be disposed and inclined at an angle to vertical as shown for improved grasping ergonomics.

Referring to FIGS. 5-8, a detachable grip 60 is removably mounted on the grip frame 22, and more particularly grasping portion 23. In one embodiment, the grip 60 may have a generally U-shaped body in transverse cross-section including a rear wall 61 defining a backstrap which conjoins a spaced apart pair of sidewalls 62*a*, 62*b* defining side panels. The grip 60 defines a forward facing and open cavity 63 configured to receive a portion of the grip frame 22 therein. The rear and sidewalls of the grip may be vertically elongated and have an axial length (measured vertically albeit at an angle) that may be substantially coextensive with a majority of the corresponding axial length of the grasping portion 23 of the grip frame 22 on which the grip is mounted. In one embodiment, the rear wall 61 of the grip includes mounting features configured to lockingly engage mounting features formed on the rear side of the grip frame, as further described herein.

The grip frame 22 and grip 60 include mating pairs of complementary configured guide or mounting slots and guide or mounting rails, respectively. In one embodiment, referring to FIGS. 1-8, the grip frame 22 includes a first laterally spaced pair of mounting slots 70 configured to receive a first mating laterally spaced pair of mounting rails 71 formed in the grip 60. The mounting slots 70 may be oriented substantially parallel to the rear wall 25 of the grip frame 22 so that the mounting rails are freely and uniformly slideable into the slots without binding or increased pressure as the rails become further inserted into the slots. The mounting slots 70 are vertically elongated and may be disposed at the rear wall 25 of the grip frame somewhat proximate to the sidewalls 26*a*, 26*b* and on either side of the grip mounting axis GA. The mating mounting rails 71 may similarly be disposed on the rear wall 61 of the grip 60 inside the cavity 63 somewhat proximate to the sidewalls 62*a*, 62*b*. The mounting slots and rails properly locate and position the grip on the grip frame, in addition to securing the grip to the grip frame as further described herein.

In one embodiment, the mounting slots 70 of the grip frame 22 may form laterally outward and downwardly facing open recesses 72. The mounting slots 70 are defined the rear wall 25 of the grip frame 22 and an opposing parallel axially-extending upper surface 73 formed by a raised protrusion 74 on the rear wall 25 of the frame. In one embodiment, the top end of each slot 70 is closed and the bottom end is open (see, e.g. FIG. 3 and particularly 11) to allow axial insertion of the mounting rail 71 into the slot through the open bottom. The closed top end of slots 70 serve to limit the axial insertion depth of the mounting rails 71 into slots 70 thereby ensuring that the grip is fully seated on grip frame 22 (i.e. grasping portion 23) so that cam operating aperture 135 is aligned with the centerline CL2 of cam receptacle 102 for locking/unlocking the grip 60.

The mounting rails 71 may be formed by inwardly facing projections 75 disposed on the grip inside the cavity. In one embodiment, the rails 71 may be formed on L-shaped projections 75 (in transverse cross-section) having one leg attached to the rear wall 61 of the grip 60 and the remaining perpendicular free leg projecting laterally inwards therefrom towards the centerline CL1 of the grip. The perpendicular leg of the L-shaped mounting rails 71 may be spaced apart from the rear wall 61 of the grip 60 forming a gap therebetween for receiving a portion of the frame protrusion 74 therein when the grip is mounted on the grip frame 22.

In one embodiment, the grip frame 22 and grip 60 includes a second mating pair of complementary configured bottom guide or mounting slots and rails. In one embodiment, with continuing reference to FIGS. 1-8, the grip frame 22 includes a second laterally spaced pair of mounting slots 80 configured to receive a second mating laterally spaced pair of mounting rails 81 formed in the grip 60. The bottom mounting slots 80 and rails 81 may be configured similarly in general to top mounting slots 70 and rails 71 described above and function in a similar manner. The first pair of mounting slots 70 are spaced axially apart from the second pair of mounting slots 80 along the grip mounting axis GA forming a transverse opening or entrance 82 therebetween that allows for insertion of the first pair of mounting rails 71 therein for mounting the grip. The first pair of mounting rails 71 similarly are spaced axially apart from the second pair of mounting rails 81 along the grip centerline CA1 forming an opening or entrance 83 therebetween that allows insertion of a portion of the raised protrusion 74 of grip frame 22 therein that defines the mounting slots 80. In other embodiments, the second pair of mounting rails 81 may be formed on a separate raised protrusion 74 on the grip frame 22 (see, e.g. FIG. 11).

Interaction between the mounting slots 70, 80 and rails 71, 81 prevent withdrawal and removal of the grip 60 from the grip frame 22 in a perpendicular direction to the grip mounting axis GA (i.e. along the transverse axis TA) when the rails are positioned in the slots (see, e.g. FIG. 2). In one embodiment, grip frame 22 may include a pair of laterally spaced and raised stop surfaces 141 shown in FIGS. 3 and 11 to keep the grip 60 from sliding down too far when removing grip. Stop surfaces 141, formed on a protrusion on rear wall 25 of grip frame 22, may be positioned to engage the bottom ends of mounting rails 71 (see also FIGS. 5-7). In that configuration, the stop surfaces 141 are disposed at the top ends of each of the bottom mounting slots 80 adjacent the rearwardly open entrance 82 formed between the top and bottom mounting slots 70, 80. The raised structure defining stop surfaces 141 therefore further serves to limit the axial insertion depth of the bottom mounting rails 81 into slots 80.

Figure 5:
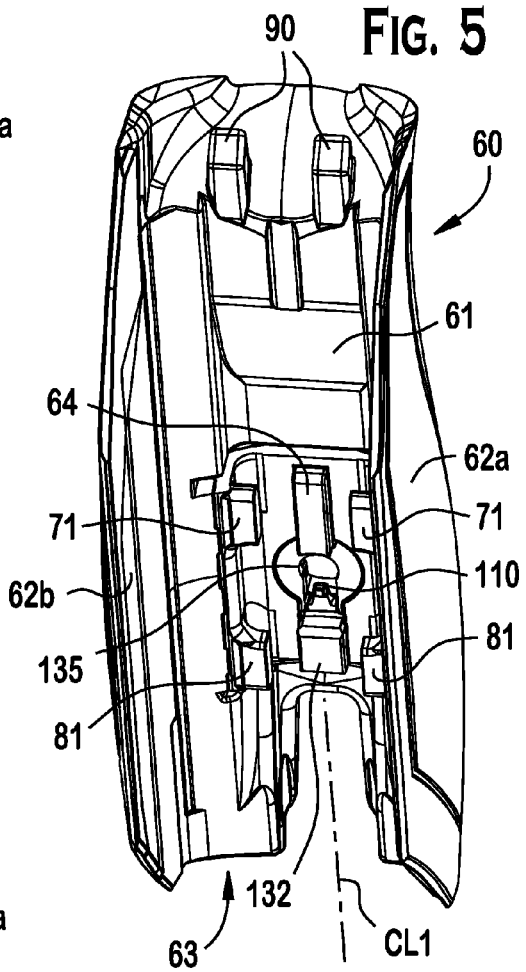
Figure 7:
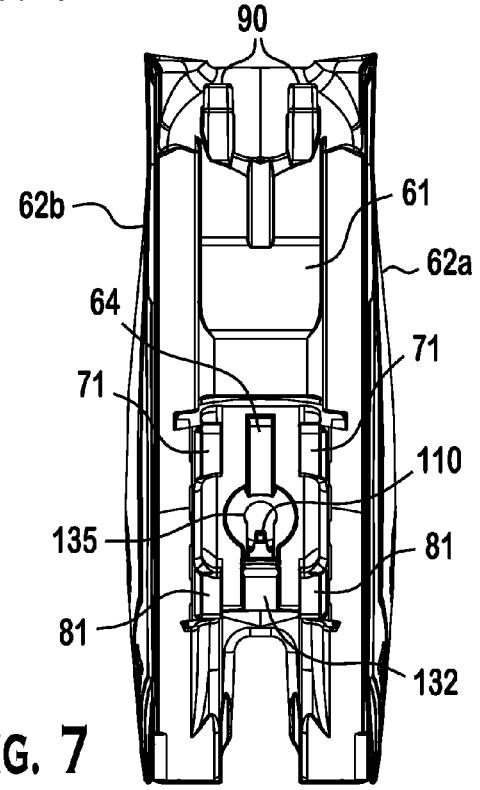
Figure 7A:
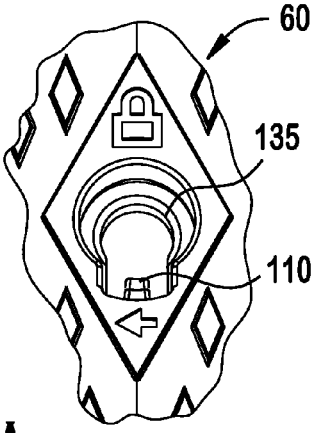
FIG. 7A is an enlarged view of the exterior of the grip and a cam operating aperture.
Figure 8:
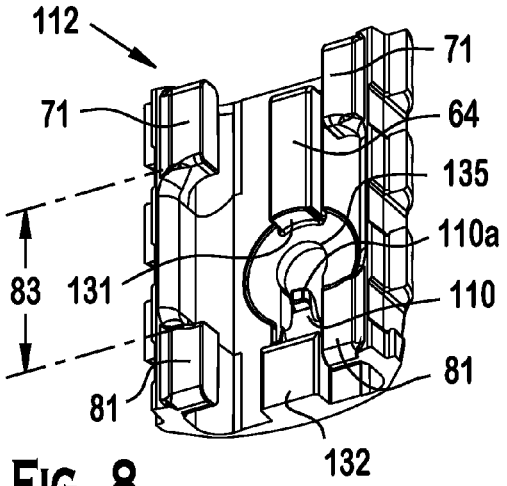
FIGS. 8-8E are various views of a grip insert mountable in the grip.
Figure 8A:
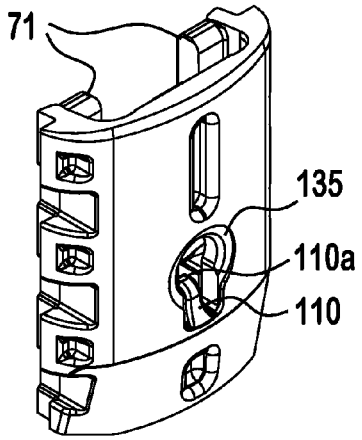
Figure 8B:
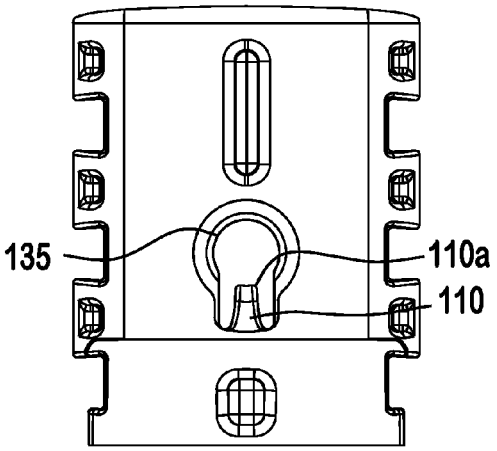
Figure 8C:
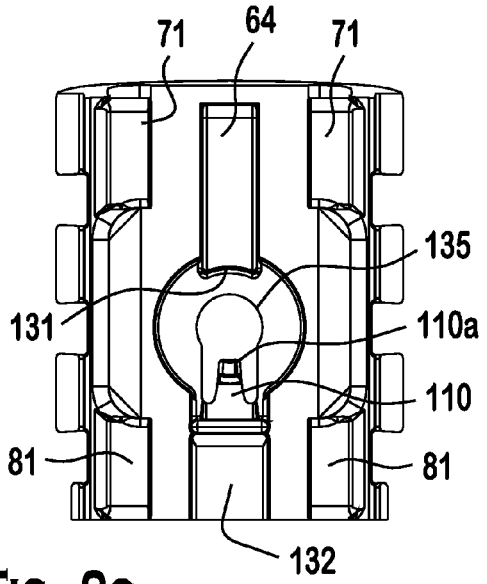
Figure 8D:
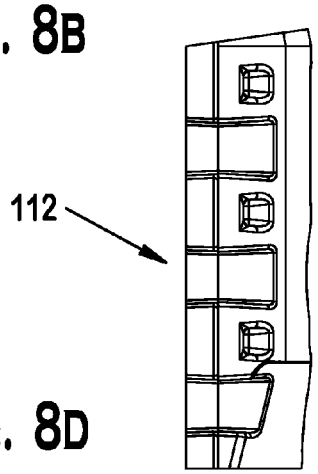
Figure 8E:
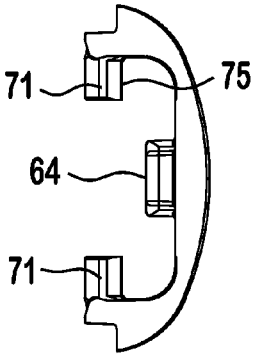
Figure 9:
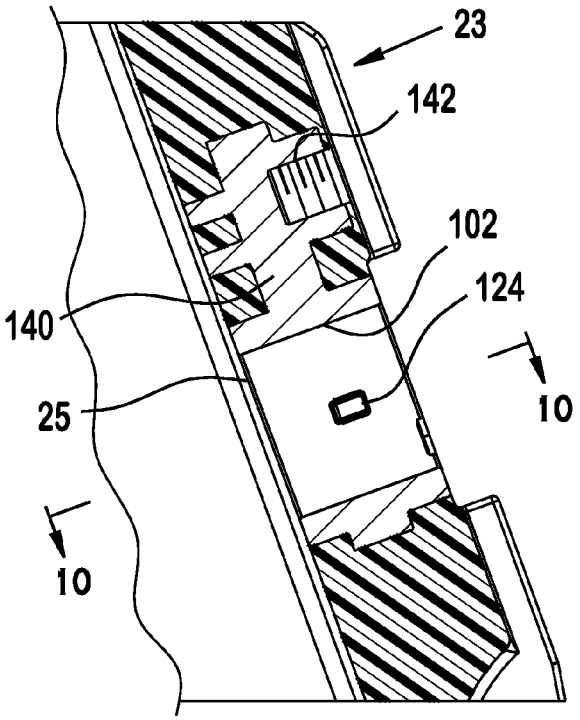
FIG. 9 is a side cross-sectional view of the grip frame showing a cam receptacle.
Figure 10:
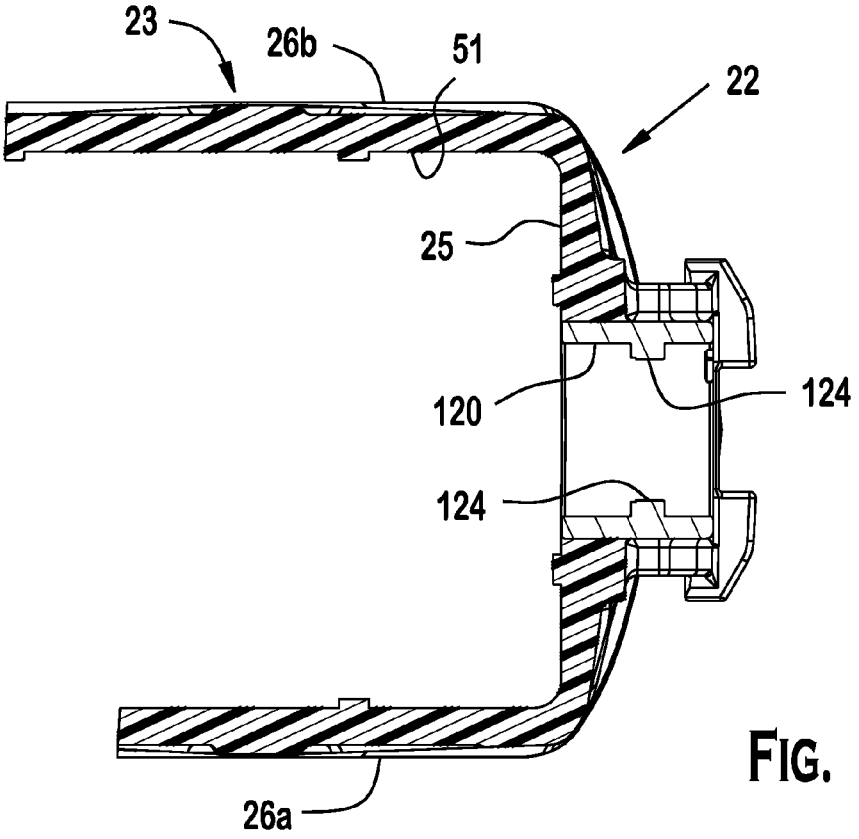
FIG. 10 is a top cross-sectional view of the grip frame showing the cam receptacle.

The grip 60 further includes a pair of top mounting tabs 90 which are slideably and insertably received in a mating pair of tab pockets 91 formed in the grip frame 22 (see, e.g. FIGS. 3 and 5. The tabs 90 act to secure the top portion of the grip to the grip frame to further stabilize the grip when fully mounted. Tabs 90 may be formed in the grip cavity 63 in one embodiment. In one embodiment, the tab pockets 91 may be formed at the top of the grasping portion 23 of the grip frame 22 beneath the rear end of the grip frame.

The grip 60 also includes an elongated locking rail 64 which is slideably received in a corresponding elongated locking slot 65 formed in the grip frame 22. In one embodiment, the locking rail 65 may be disposed and axially aligned with the axial centerline of the grip CL1 being located approximately midway between the lateral sidewalls 62*a*, 62*b* of the grip. Locking rail 64 is equidistantly disposed between mounting rails 71. The locking slot 65 may similarly be disposed and axially aligned with the grip mounting axis GA of the grip frame being disposed approximately midway between the lateral sides 26*a*, 26*b* of the grip frame 22. When the grip 60 is mounted on the grip frame 22, the locking rail 64 is axially alignable with the mounting axis GA and locking slot 65 of the grip frame for locking the grip to the pistol, as further described herein. The locking slot 65 further functions as an alignment guide or slot to facilitate mounting the grip on the grip frame.

In some embodiments, grip 60 may also include an alignment rail 132 which is slideably received in a mating alignment groove 134 formed in grip frame 22 (see FIGS. 5-8 and 11). This facilitates properly aligning the grip 60 with the grip frame 22 for mounting and guides the grip along the grip mounting axis GA together with the mounting rail 74 during the mounting process.

The firearm grip mounting system further includes a rotary camlock mechanism comprising a rotatable locking cam 100 which is disposed in complementary configured and dimensioned cam receptacle 102 formed in the rear side 25 of the grip frame 22, and more particularly in grasping portion 23. Referring to FIGS. 3, 4, and 11-14, cam receptacle 102 is rearwardly open for insertably receiving the cam 100.

Figure 23:
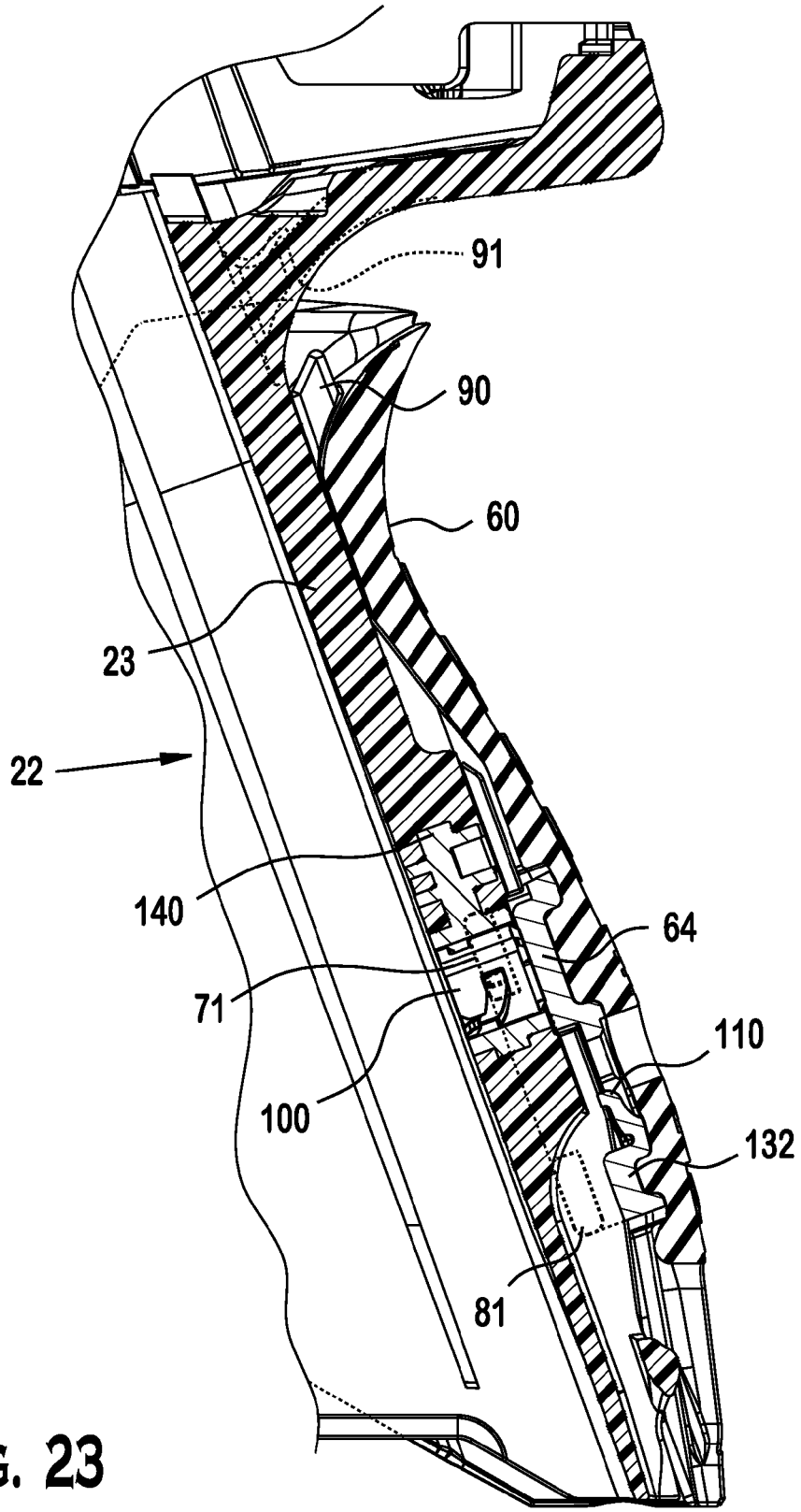
FIG. 23 is a side cross-sectional view thereof showing a grip locking rail positioned and slidable over the locking cam.
Figure 24:
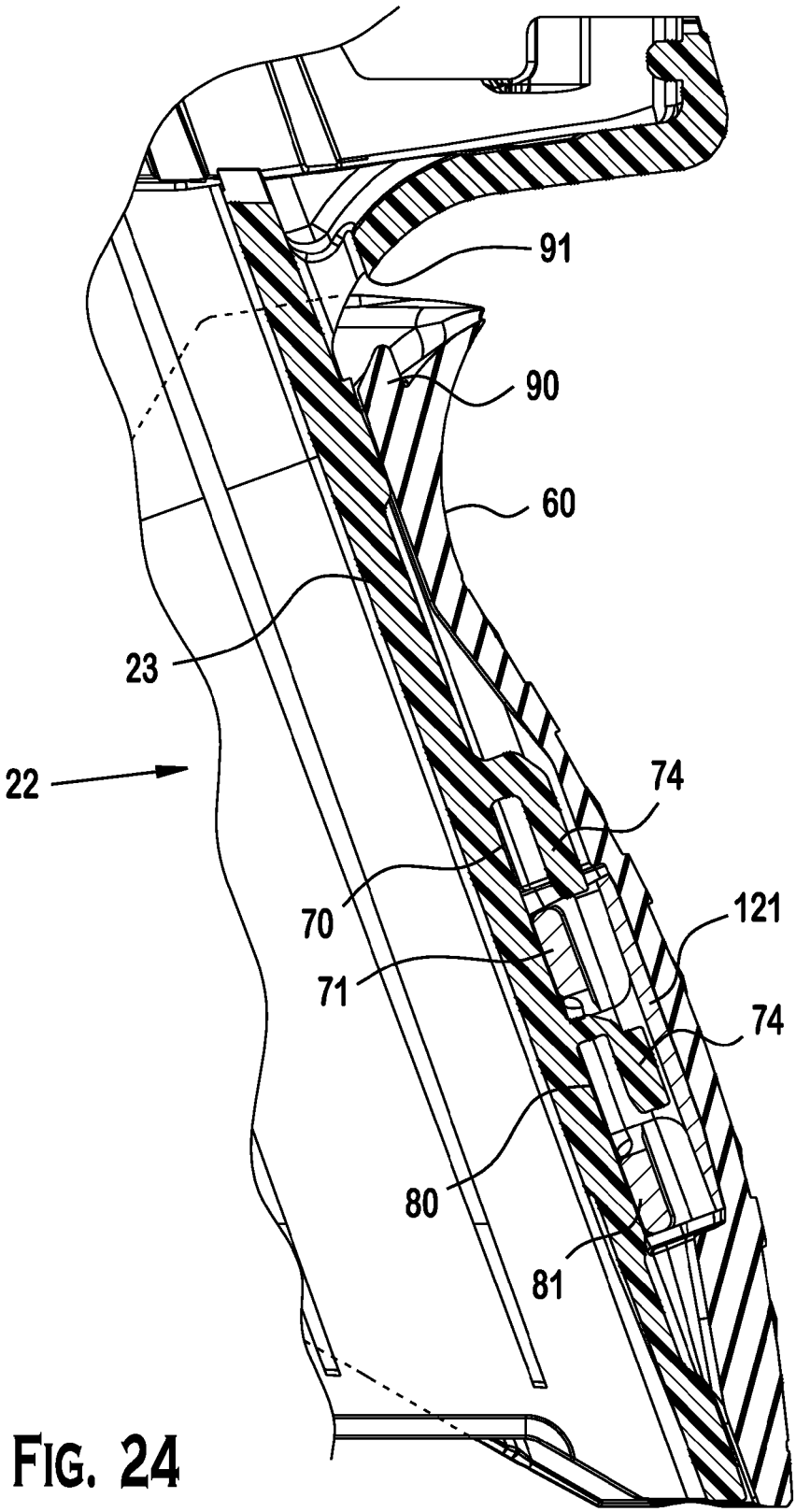
FIG. 24 is an additional side cross-sectional view thereof showing mounting rails of the grip positioned below mating mounting slots in the grip frame.
Figure 25:
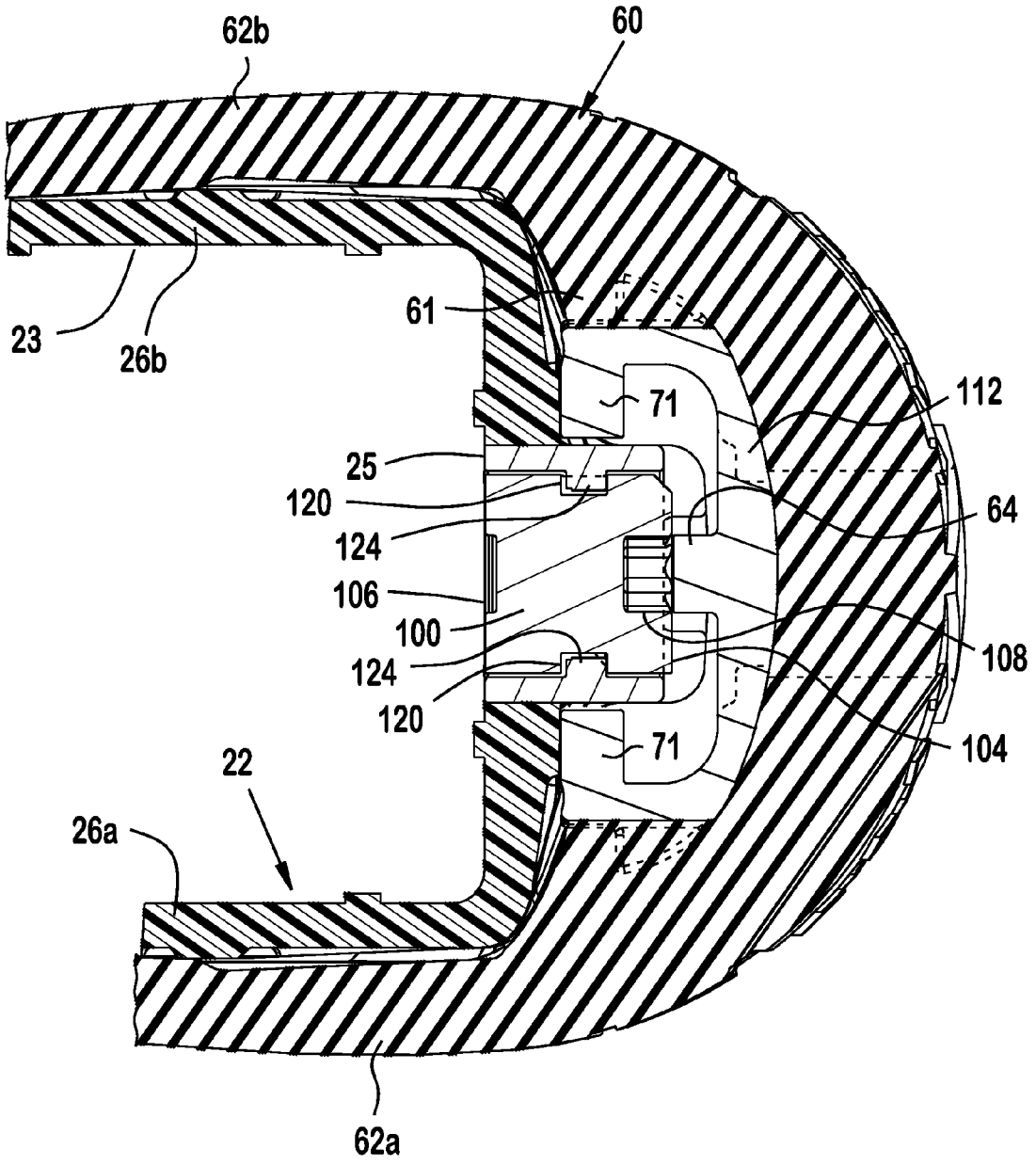
FIG. 25 is a top cross-sectional view thereof showing the locking cam in the retracted unlocked and unblocking position.
Figure 26:
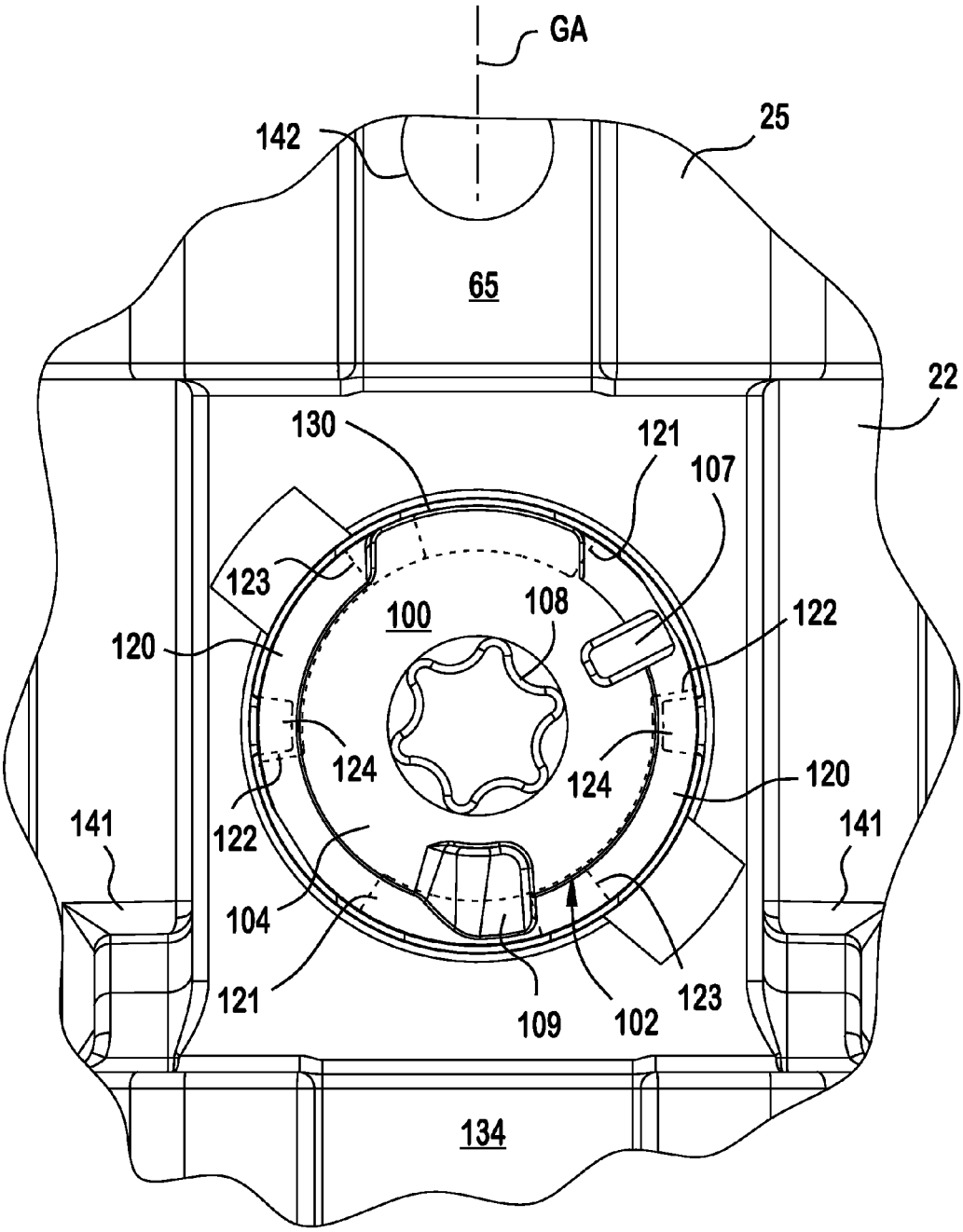
FIG. 26 is a rear view of the grip frame showing the locking cam in the locked rotational position.
Figure 27:
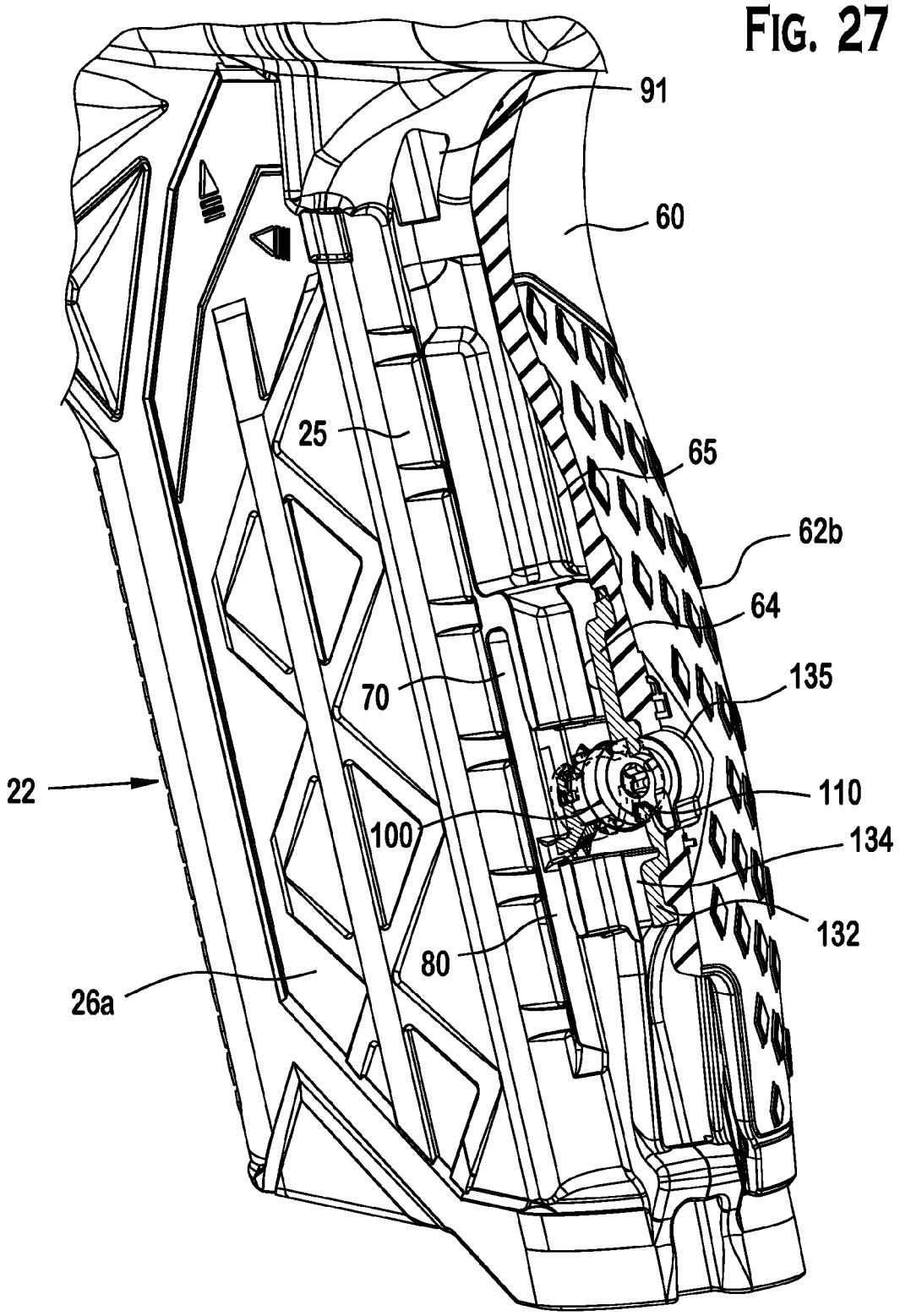
FIG. 27 is a rear perspective view thereof of the grip frame showing the grip positioned thereon in an upward locked and fully mounted position.
Figure 28:
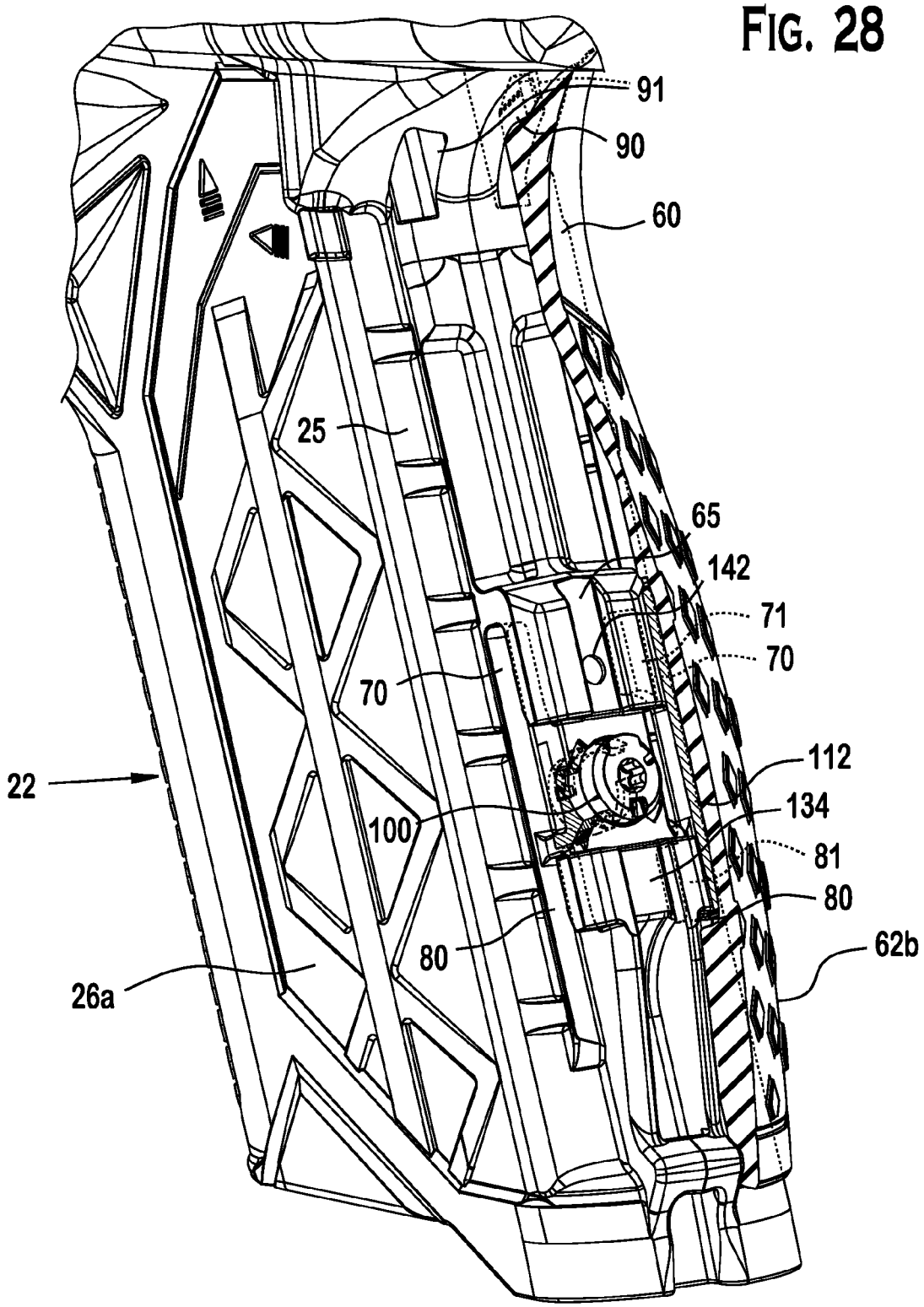
FIG. 28 is an additional perspective view thereof showing grip top mounting tabs inserted in the mating mounting pockets of the grip frame.

With continuing reference to FIGS. 3, 4, and 11-14, locking cam 100 is rotatably movable between a locked position shown in FIG. 27 in which the grip cannot be removed from the pistol 20 (i.e. grip frame 22) and an unlocked position in shown in FIG. 23 which the grip may be removed from the pistol. The locked position is also an inward recessed position of the locking cam 100 in which the cam fully retracts inside the cam receptacle 102. The unlocked position is also an outward projected position of the locking cam 100 in which a portion of the cam projects above the rim 111 of the receptacle 102 to block removal of the grip 60, as further described herein.

The cam 100 is rotationally moveable using an appropriately configured key or tool between a locked position and an unlocked position. In one embodiment, the locking cam has a generally cylindrical body including an outward facing top surface 104 (facing away from the grip frame, an opposing inward facing bottom surface 106 (facing towards the grip frame), and circumferentially extending circular sidewall surfaces 105 extending between the top and bottom. The top surface 104 may include a recessed operating socket 108, which may extend partially into or completely through the cam body to bottom surface 106 in various embodiments. In one embodiment, the operating socket 108 is centered in the cam top surface 104 between sidewalls 105 and axially aligned with the cam receptacle centerline CL2 when the cam is mounted therein. The operating socket 108 is configured to receive a working end of a complementary shaped key or tool that may be used to rotate the cam between the locked and unlocked positions. In one embodiment shown, operating socket 108 may be a star shaped hexalobular or T10 socket. This female socket is configured to receive a key or screwdriver having a complementary configured star-shaped male working end which positively engages the socket to rotate the locking cam 100. In other possible embodiments, the operating socket may be shaped as an elongated slot to be operated with a slotted screwdriver or key. It will be appreciated that numerous other shapes of operating socket may be used. In other possible embodiments, the operating socket may have other such conventional shapes such as for example, without limitation, a cross (e.g. Phillips head), hexagon, square, or others. Other non-conventional and special operating socket shapes may also be used wherein a custom key is provided which is configured to engage a complementary configured operating socket.

When the grip 60 is fully mounted on the grip frame 22, the cam 100 is accessible through a cam operating aperture 135 formed through the rear wall 61 of the grip (see, e.g. FIGS. 5-8) with the key or tool. When the rotary locking cam 100 is not being locked or unlocked, the aperture 135 may be closed by a suitable configured plug or cap (not shown) to prevent ingress of moisture or dirt.

Figure 12:
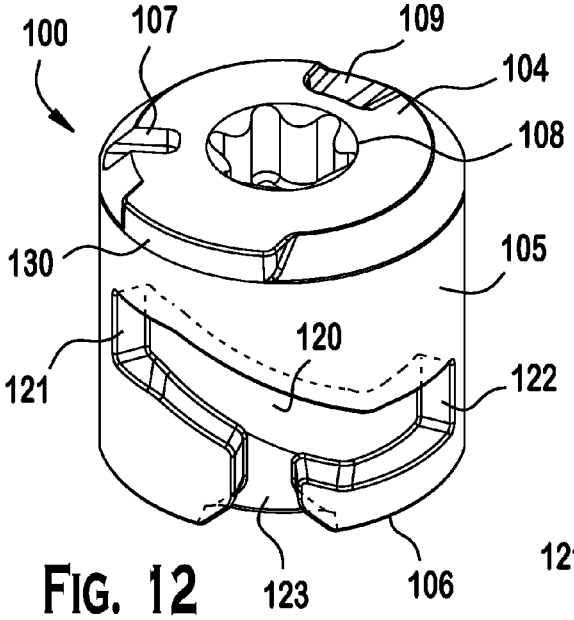
FIGS. 12-12H are various views showing features of the locking cam.
Figure 12A:
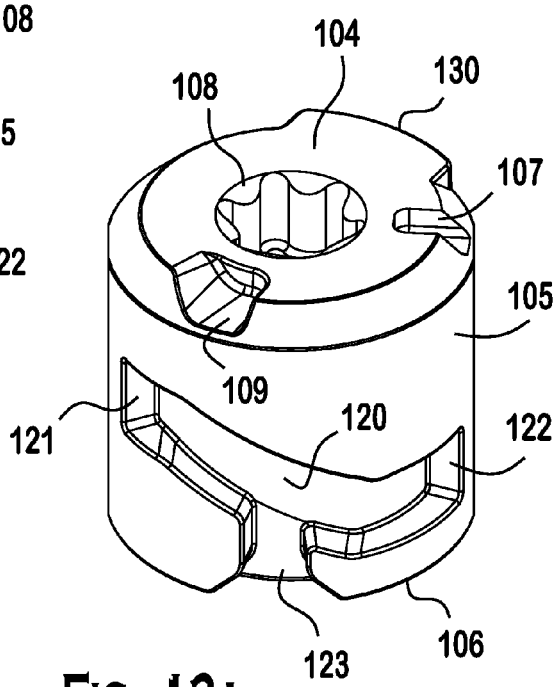
Figure 12B:
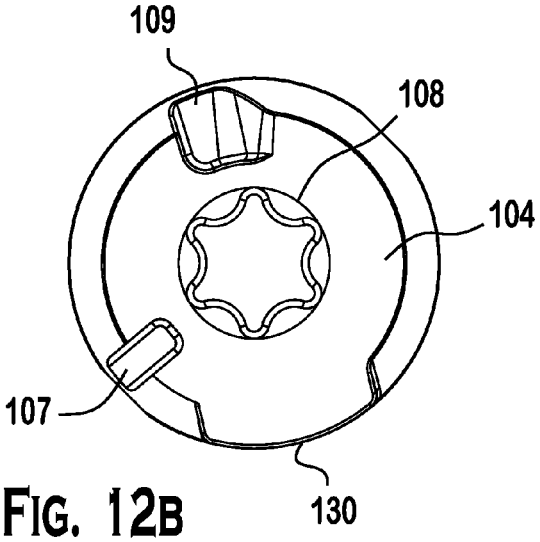
Figure 12C:
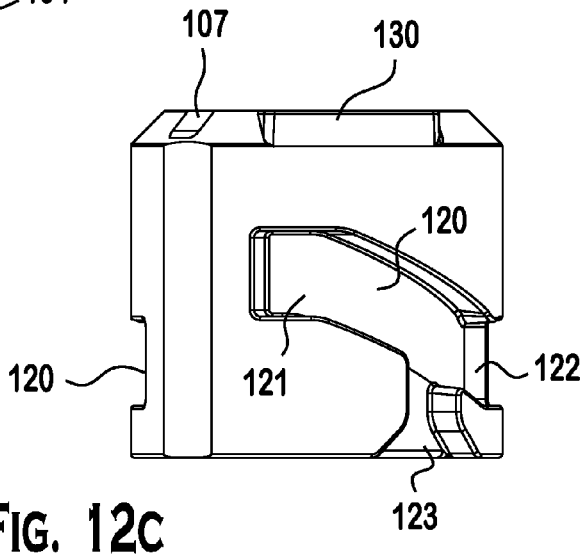
Figure 12D:
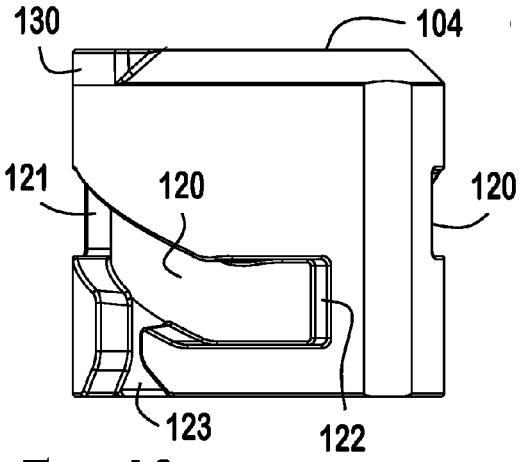
Figure 12F:
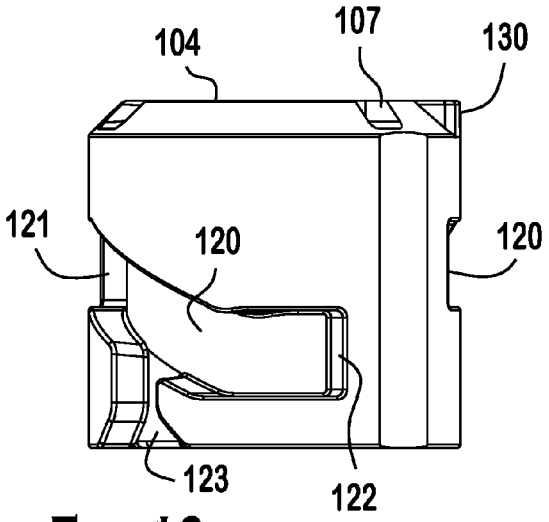
Figure 12E:
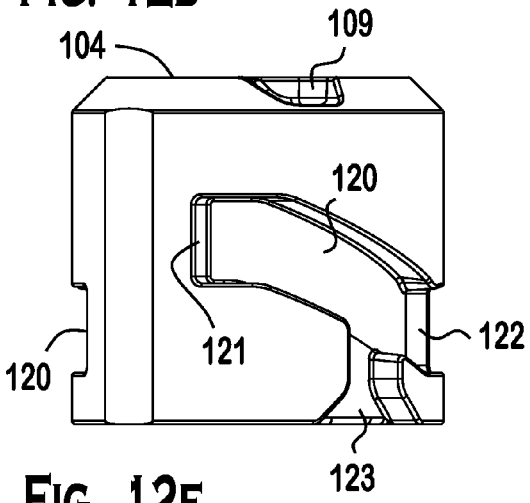
Figure 12G:
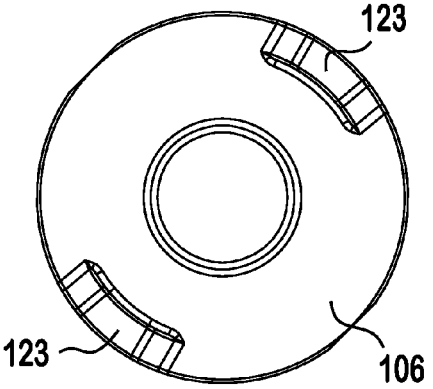
Figure 12H:
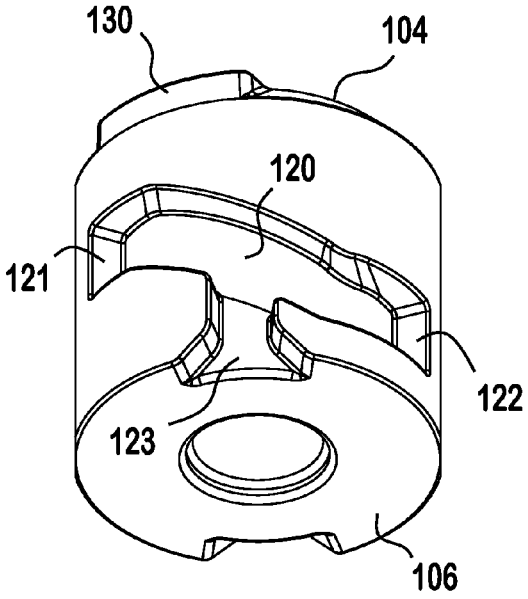
Figure 13:
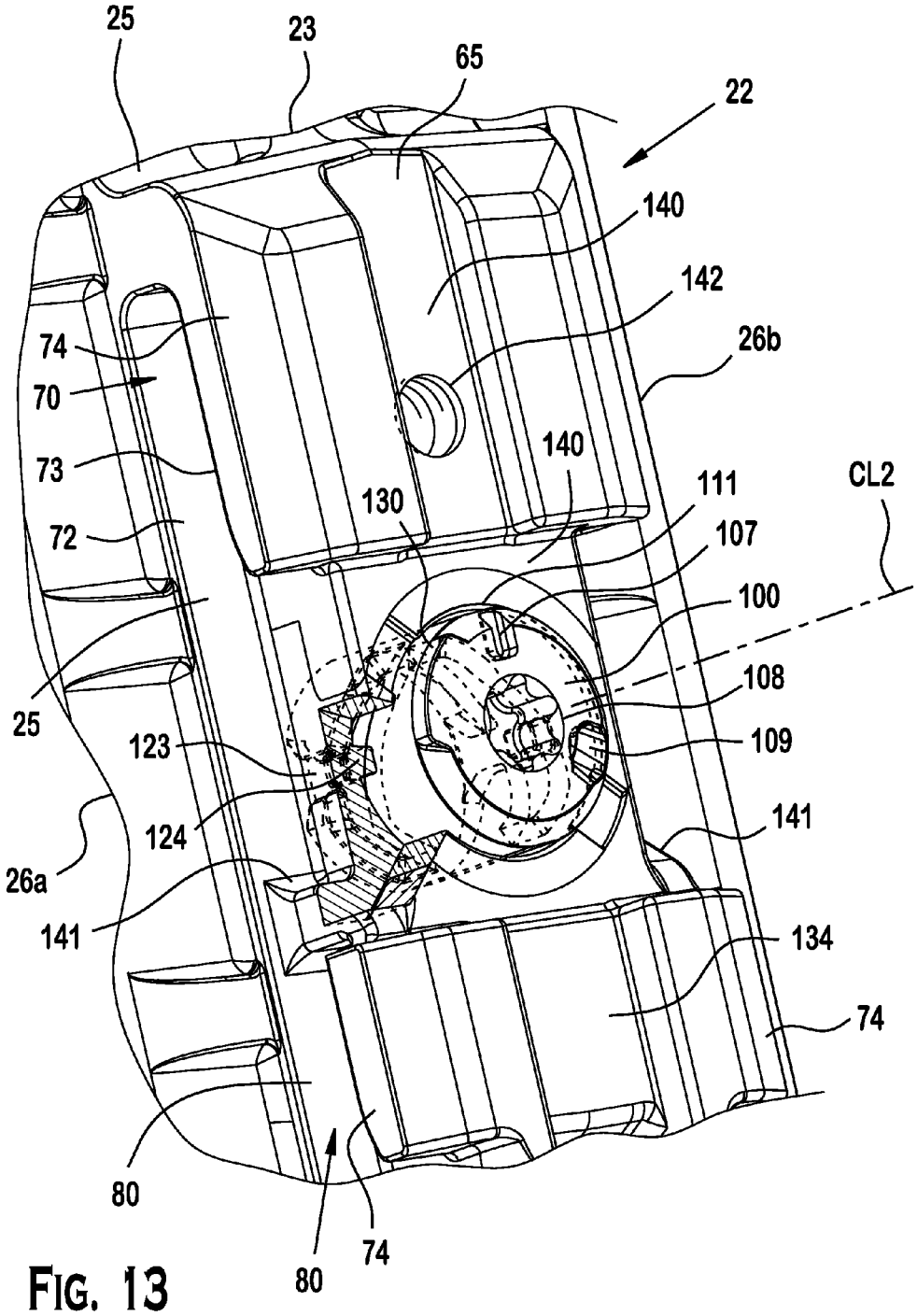
FIG. 13 is a rear perspective view of the grip frame with locking cam shown in an assembly position therein.

The top surface 104 of locking cam 100 may further include a detent recess or pocket 109 configured to engage an inwardly extending free hooked end 110*a* of an elongated resilient locking cantilevered detent arm 110 (see, e.g. FIGS. 6-7 and 27) disposed on the grip 60 for retaining the cam in the locked position during repeating firing cycles of the firearm is firearm. The detent pocket 109 may be arcuately shaped in one embodiment forming a recessed arc segment and may be disposed near the peripheral edge of the top surface 104 as shown in FIG. 12. Hooked end 110*a* of cantilevered detent arm 110 is disposed at an angle to the straight portion of arm 110 fixedly connected to the grip 60. The configuration of the cantilevered detent arm 110 provides a resiliently flexible structure with elastic spring-like properties that allows the hooked end 110*a* to deflect and move transversely to grip mounting axis GA for engaging/disengaging the cam detent pocket 109. Various embodiments of cantilevered detent arm 110 may be made of plastic or metal. In one embodiment, the detent arm 110 is formed as an integral unitary structural part of the grip 60 such as when the grip is formed of molded polymer or plastic. The hooked end 110*a* and adjacent portion of cantilevered detent arm 110 are configured and dimensioned to project into the cam operating aperture 135 as shown to engage the cam detent pocket 109.

Top surface 104 of locking cam 100 may further include an alignment mark 107 to facilitate inserting the locking cam 100 into the cam receptacle 102 during initial preassembly of the locking system before installing the grip, as further described herein. Alignment mark 107 may be formed as a recessed feature in top surface 104 of cam 100 in the shape of a line segment in one embodiment. In other embodiments, mark 107 may be formed by etching or a painting the shape onto the top surface of the cam. Other types and shapes of marks may be used.

Figure 11:
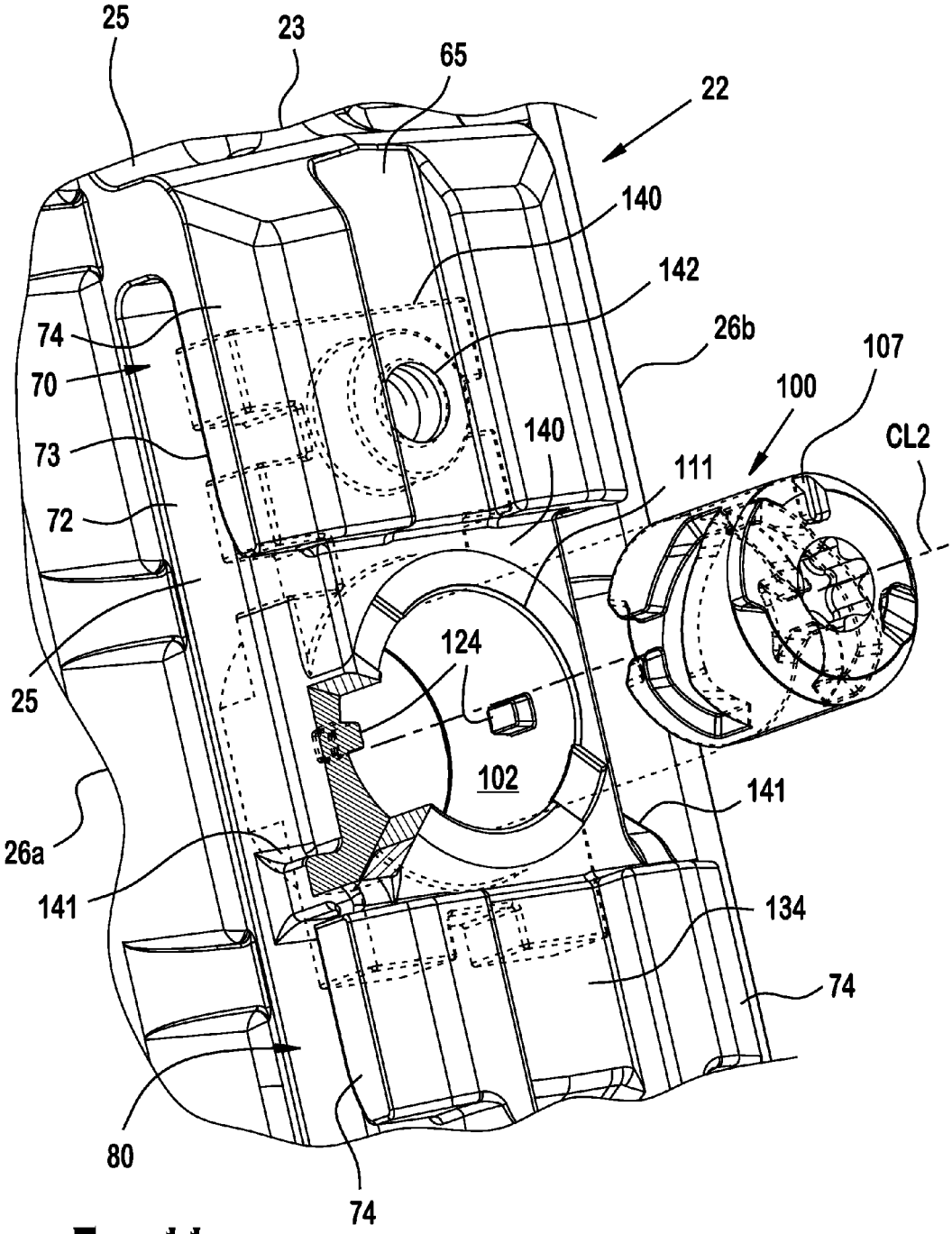
FIG. 11 is a rear perspective view of the grip frame showing a locking cam of a camlock mechanism positioned for insertion in the cam receptacle.

Referring to FIGS. 11 and 12, the circumferential sidewall surfaces 105 of the cam 100 include at least one recessed cam track 120 configured to movably receive a mating grip retention locking protrusion 124 formed in the inside surface of cam receptacle 102. In some embodiments, two cam tracks 120 and mating locking protrusions 124 may be provided on opposing sides of the sidewall surfaces. Each cam track 120 includes two opposing closed ends 121, 122. The locking protrusions 124 are movable and travel back and forth in the track 120 between each end as the locking cam 100 is rotated between the locked and unlocked positions, as further described herein. One end of the cam track 120 is a locked end 122 that defines a locked location or position of the locking protrusion 124 in the track. The other end 121 of the cam track is an unlocked end that defines an unlocked location or position of the locking protrusion in the track.

The unlocked end 121 location or position of the locking protrusion 124 in the cam track 120 is associated with an inward recessed position of the locking cam 100 in the receptacle 102 (see, e.g. FIGS. 19 and 23) wherein the grip locking rail 64 may slideably move over/past the cam and the grip 60 may be removed from the grip frame 22. In the recessed position, the bottom surface 106 of the locking cam is located proximate to the bottom of the cam receptacle 102 (i.e. adjacent grip frame rear wall 25) as shown. The locked end 122 location or position of the locking protrusion 124 in the cam track 120 is associated with an outward projected position of the locking cam 100 in the receptacle 102 (see, e.g. FIG. 27) wherein the grip locking rail 64 cannot slideably move over/past the cam and the grip 60 is prevented from being removed from the grip frame 22 when the locking rail is positioned above the cam. Accordingly, a top portion including the top surface 104 of the locking cam 100 extends outwards at least partially into and blocks the linear removal/insertion path of the grip locking rail 64. In the projected position, the bottom surface 106 of the locking cam 100 is spaced apart from the bottom of the cam receptacle (i.e. grip frame rear wall 25) forming a gap therebetween as shown in FIG. 27.

Figure 14:
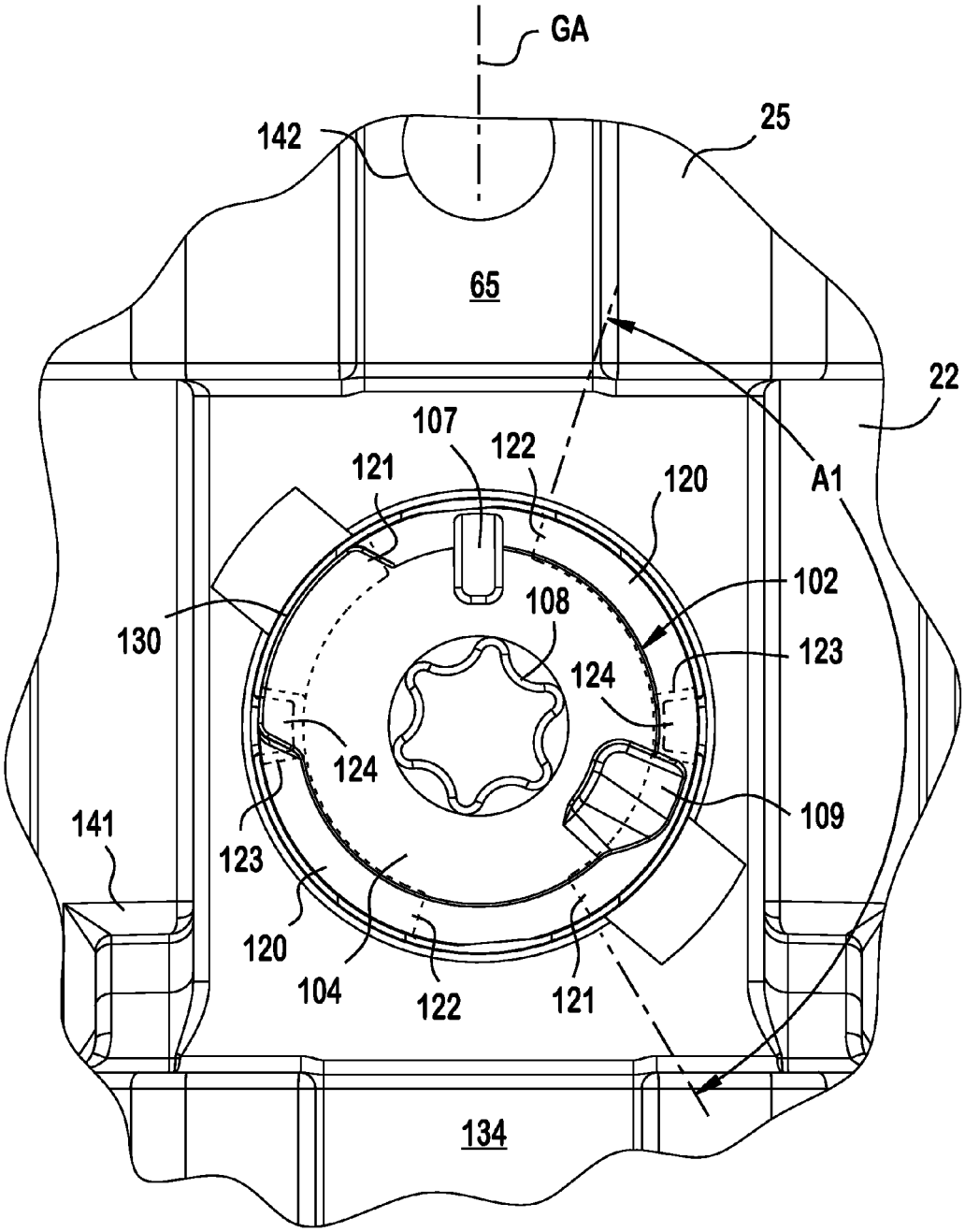
FIG. 14 is a rear view thereof showing the locking cam in the assembly rotational position.

The cam track 120 extends circumferentially along the sidewall surfaces 105 of the locking cam 100 through an angular distance denoted angle A1 with respect to the center of the locking cam (see FIG. 14). In one embodiment, the cam track 120 may extend circumferentially through an angle A1 of less than 180 degrees. In this embodiment, less than a one-half turn (i.e. less than 180 degrees) of the locking cam 100 is sufficient to move the cam from the unlocked position (i.e. locking protrusion 124 located in the unlocked end 121 of the cam track 120) to the locked position (i.e. locking protrusion 124 located in the locked end 122 of the cam track). Using this arrangement, sufficient circumferential space is provided in the circular sidewall surface 105 of the locking cam 100 to accommodate two opposing cam tracks 120 and locking protrusions 124 each traveling in a respective cam track on opposite sides of the cam. When two cam tracks 120 are used, it should be noted that the locked ends 122 of each track will essentially be diametrically opposed and the unlocked ends 121 of each track will similarly be diametrically opposed as shown.

In other possible embodiments, a single cam track and locking protrusion formed in the cam receptacle may be provided. In such embodiments, a cam track angle A1 equal to or greater than 180 degrees may be used. Numerous other variations are possible in cam track arrangements and angles of movement.

The cam track 120 is angularly disposed or inclined with respect to the top and bottom surfaces 104, 105 of the cam 100 which imparts an axial motion to the cam in a direction parallel to the centerline CL2 of the cam receptacle 102 as the locking protrusion 124 travels along the cam track from unlocked end 121 to locked end 122 (reference FIGS. 11-12). The centerline CL2 of the cam receptacle 120 may be oriented substantially perpendicular and transverse to the mounting axis GA of the grip frame 22. In one embodiment, the angle A2 of the cam track 120 to the bottom surface 105 of the cam 100 may be between 0 and 45 degrees (see also FIG. 15). The unlocked and locked ends 121, 122 may be non-inclined or flat being oriented approximately parallel to the cam bottom surface 105 to help retain the locking protrusion 124 therein. The locked end 122 of the cam track defining the locked location of the locking protrusion 124 is closer to the bottom surface 105 of the locking cam 100 than the opposing unlocked end 121 defining the unlocked position of the locking protrusion. Accordingly, rotating the cam in opposing rotational directions alternatingly projects and retracts the cam from the receptacle via sliding engagement between the locking protrusion and the cam track surfaces.

Referring to FIGS. 11-12, an assembly slot 123 which penetrates the bottom surface 105 of the locking cam 100 is further provided for initially mounting the locking cam in the cam receptacle 102. The assembly slot 123 communicates with the cam track 120 and may be disposed substantially transverse or perpendicular in orientation to the cam track and generally parallel to the centerline CL2 of the cam receptacle 102 (see, e.g. FIG. 15). In one embodiment, the assembly slot 123 is preferably located between the closed ends 121, 122 of the cam track so as to not interfere with the locked and unlocked positions of the locking protrusion 124 in the cam track ends, and more preferably approximately midway between the ends in one non-limiting embodiment.

In one embodiment, the locking protrusion(s) 124 may each be in the form of a raised tab which extends radially inwards from the circumferential sidewall surfaces of receptacle 102 and towards the axial centerline CL2 of the receptacle. To mount the locking cam 100 in the cam receptacle 102, the cam is slideably and axially inserted into the receptacle along the receptacle centerline CL2 with an orientation such that the locking protrusion 124 enters the assembly slot 123 of the cam and then enters the cam track 120 between the opposing closed ends 121, 122 (see, e.g. FIGS. 11, 12, and 15). The alignment mark 107 may be used to orient the cam 100 properly for insertion into assembly slot 123 by aligning the mark with hole 142 in the grip frame insert 140 and/or locking slot 65 (see also FIGS. 3-4). The cam 100 may then be rotated in a first rotational direction using the key or tool (not shown) to move the locking protrusion 124 into the unlocked location at the first unlocked end 121 of the cam track 120. The locking cam 100 is now located in an inward recessed position in the grip frame ready for mounting the grip 60 onto the grip frame 22 wherein the locking rail 64 of the grip may freely slide up past the cam (see, e.g. FIG. 23). The top surface of the cam 100 is substantially flush with or slightly recessed below the top rim 111 of the receptacle 102 (see also FIG. 23).

Figure 15:
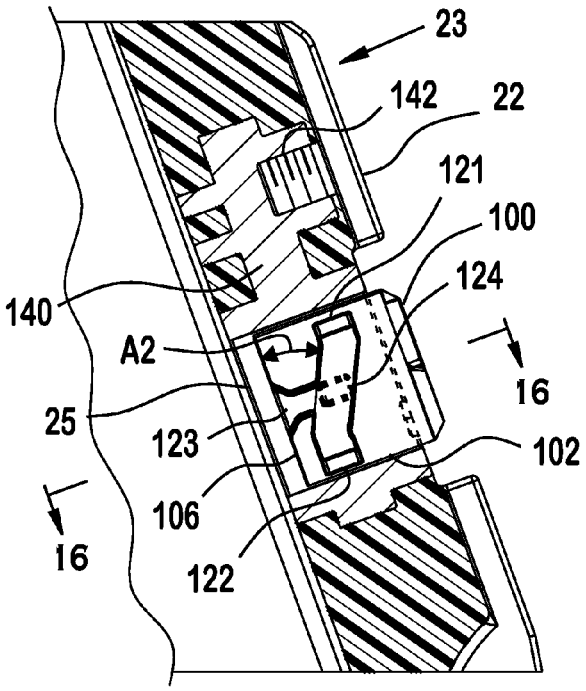
FIG. 15 is a side cross-sectional view thereof.
Figure 16:
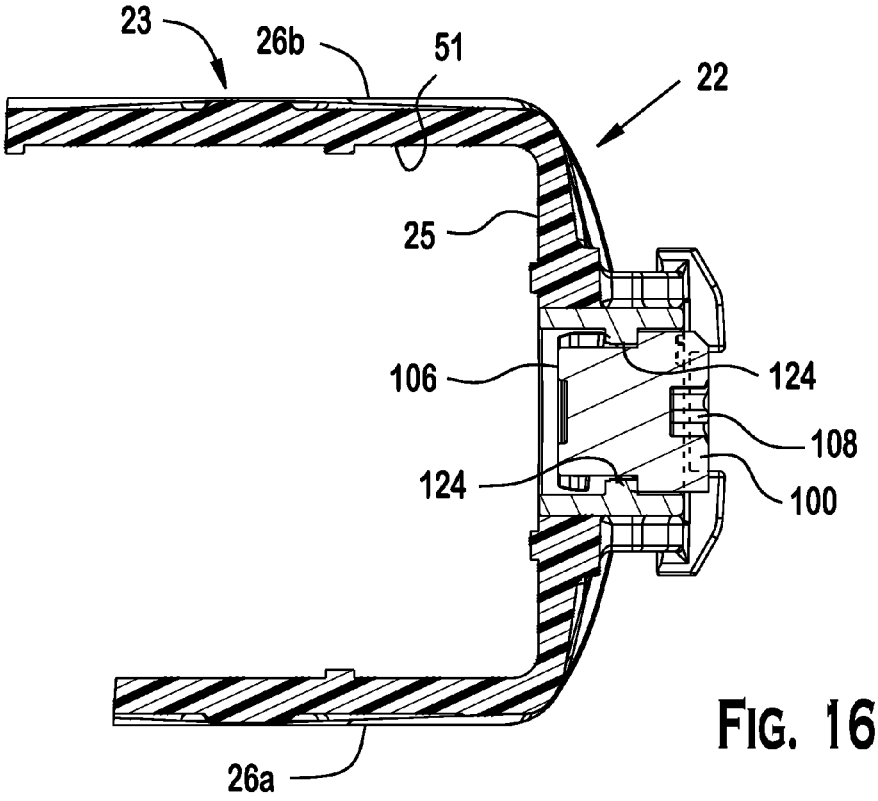
FIG. 16 is a top cross-sectional view thereof.
Figure 17:
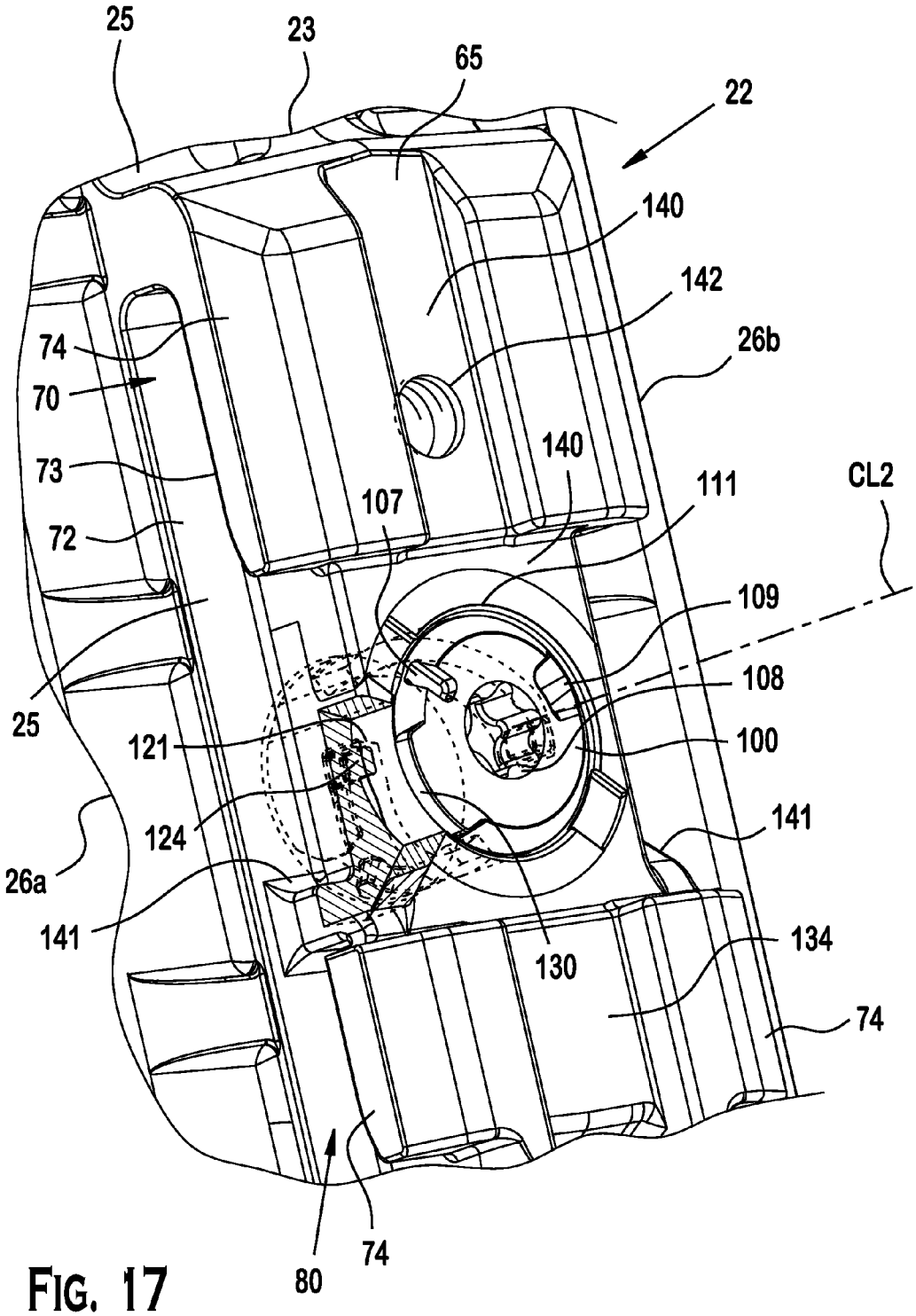
FIG. 17 is a rear perspective view of the grip frame with locking cam shown in a rotated unlocked position therein.
Figure 18:
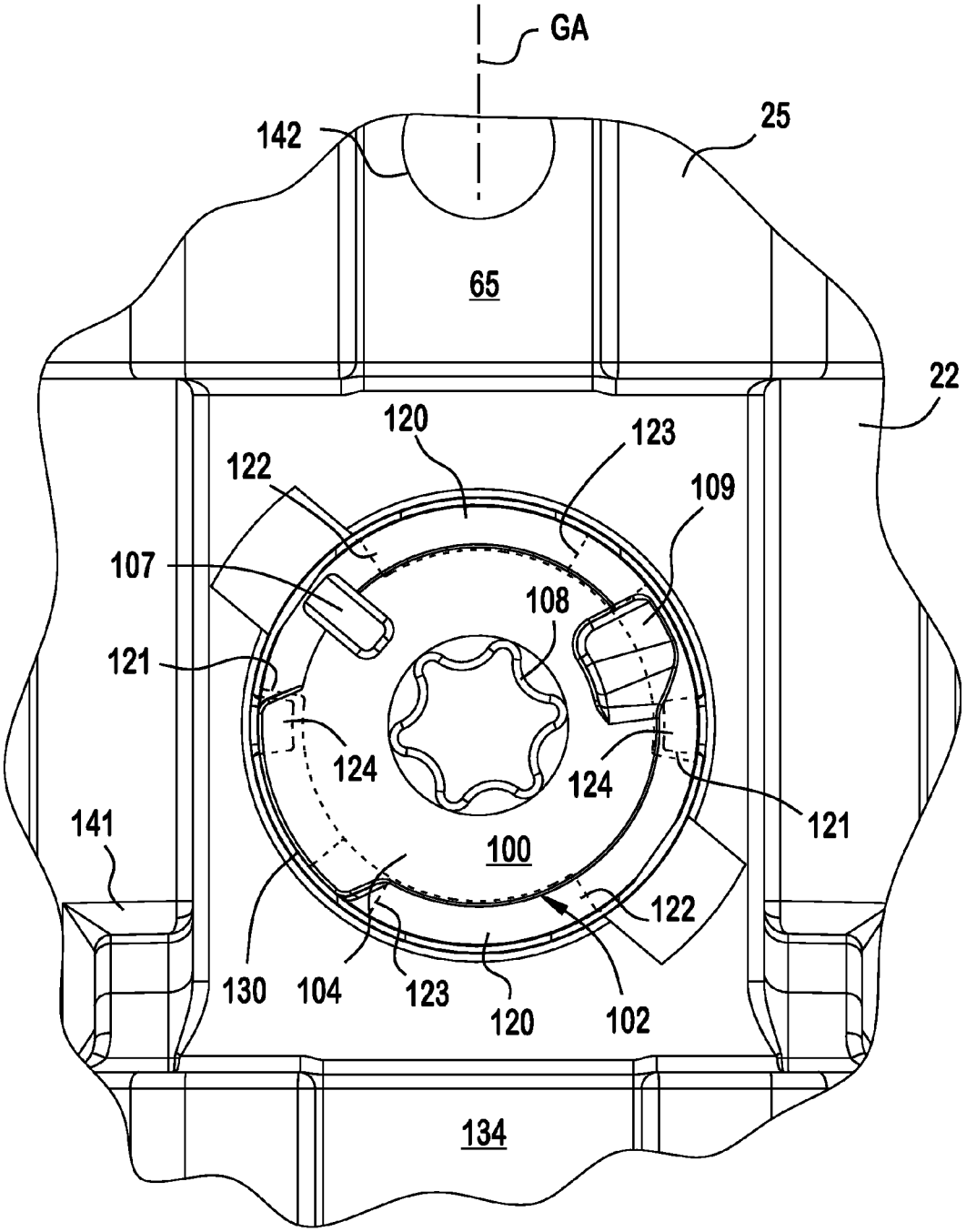
FIG. 18 is a rear view thereof showing the locking cam in the unlocked rotational position.
Figure 19:
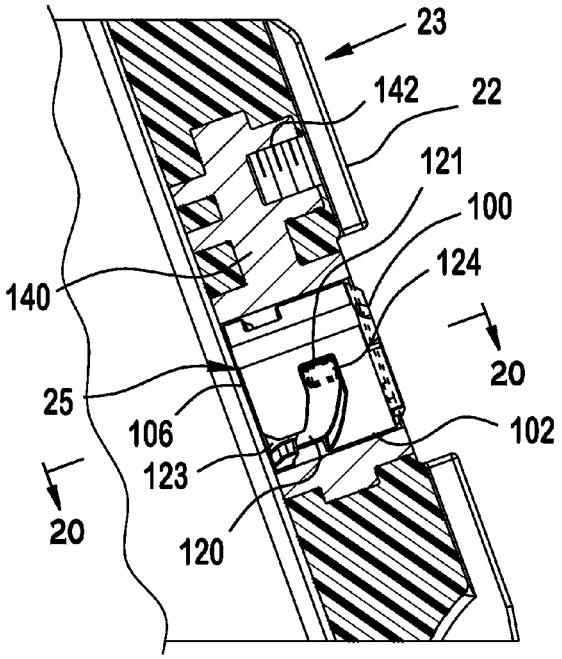
FIG. 19 is a side cross-sectional view thereof.
Figure 20:
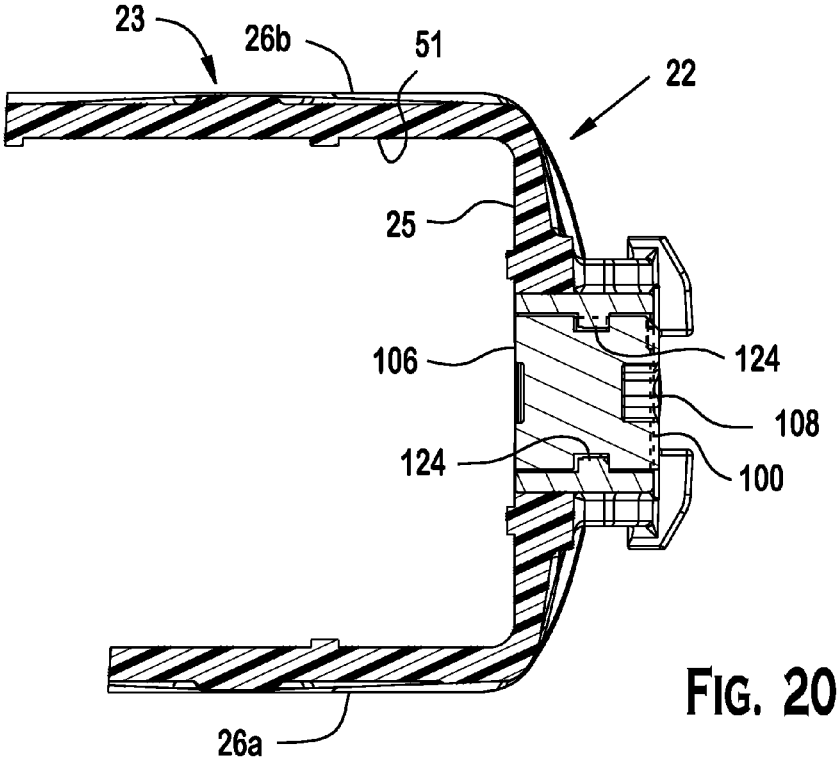
FIG. 20 is a top cross-sectional view thereof.
Figure 21:
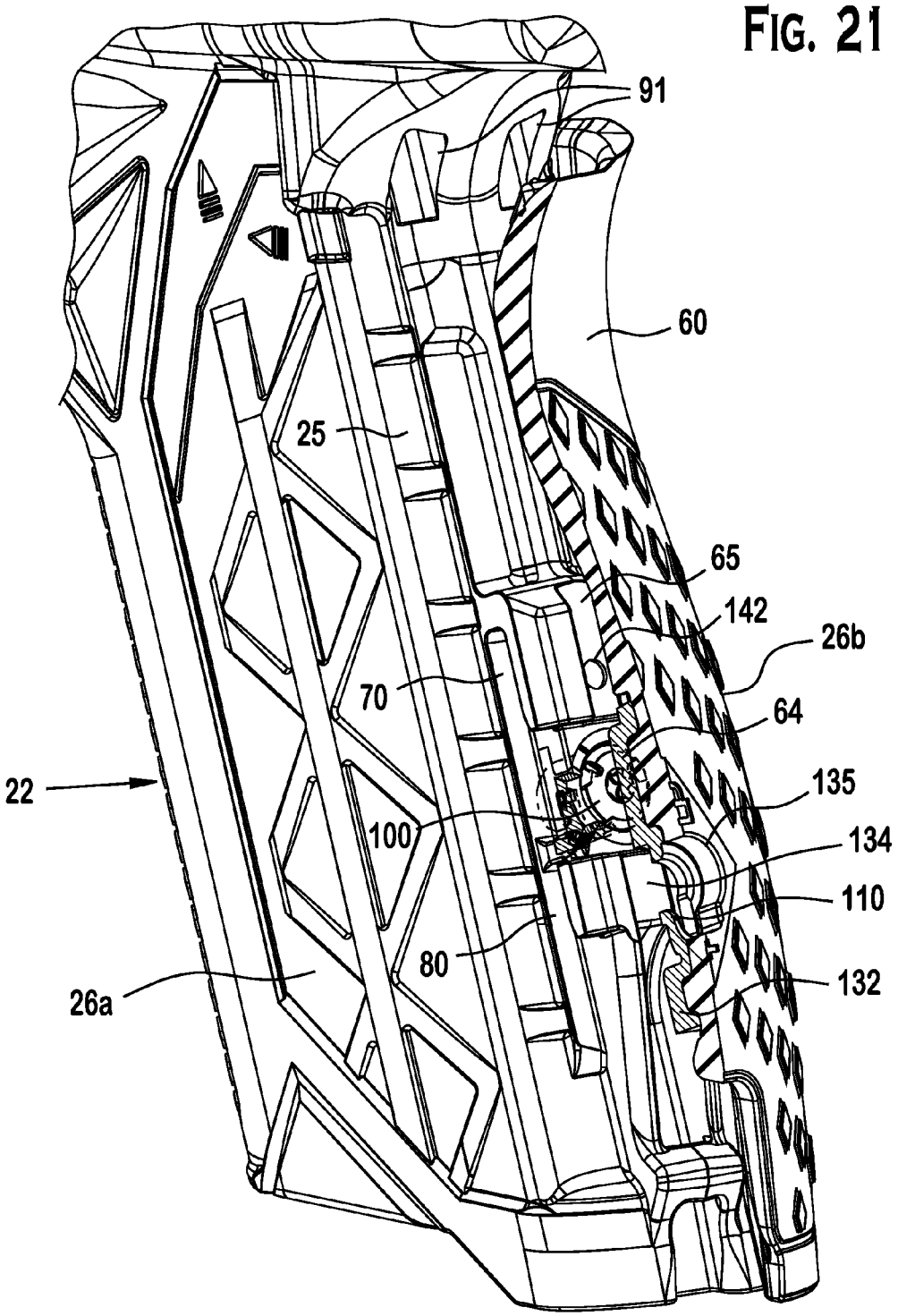
FIG. 21 is a rear perspective view of the grip frame showing the grip positioned thereon in a downward unlocked and partially mounted position.
Figure 22:
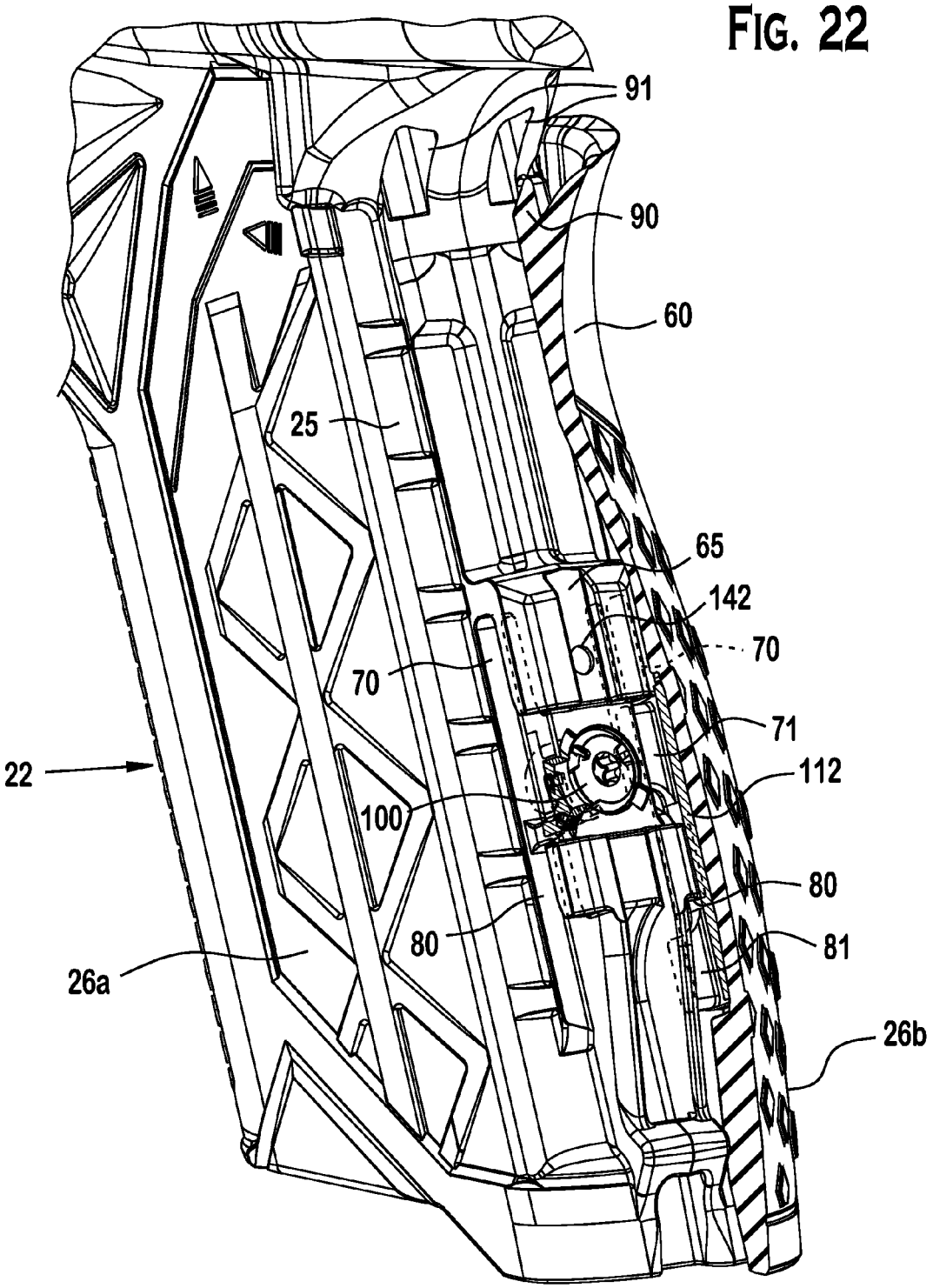
FIG. 22 is an additional perspective view thereof showing grip top mounting tabs positioned for insertion into mating mounting pockets of the grip frame.

It should be noted that the locking cam 100 is rotatable with respect to the receptacle 102 when the locking protrusion 124 is positioned in the cam track 120 (see, e.g. FIG. 15). When the locking protrusion 124 is located within the assembly slot 123, the cam 100 cannot be rotated.

To prevent removal of the grip 60 when fully seated and mounted on grip frame 22, locking cam 100 includes a blocking surface 130 which is rotationally alignable with a corresponding abutment surface 131 formed on the grip 60 when the cam is in the locked position (see FIG. 27). Referring to FIGS. 5-8 and 12, blocking surface 130 is formed on a peripheral portion of cam 100 at the interface between the top surface 104 and sidewalls 105 (see FIG. 12). In one embodiment, the blocking surface may be formed from a full diameter portion of the cylindrical locking cam 100 at that location. Blocking surface 130 may have any suitable shape, which in one exemplary embodiment is arcuately curved a shown. The blocking surface 130 may also be flat in other embodiments. Blocking surface 130 is located diametrically opposite detent pocket 109 so that when the cam 100 is rotated to the locked position, the blocking surface will be positioned at the top or 12 o'clock position of the cam receptacle 102 and the detent pocket is at the bottom or 6 o'clock position. This positions the blocking surface 130 to engage the grip abutment surface 131 and detent pocket 109 to engage the resilient locking cantilevered detent arm 110.

Abutment surface 131 is formed on a portion of the grip 60 above the cam receptacle 102 and axially aligned with grip mounting axis GA when the grip is fully mounted on the pistol 20. This positions the abutment surface 131 to engage the blocking surface 130 of the cam 100 when the cam is in the locked position, thereby locating the blocking surface in the axial removal path traveled by the abutment surface to prevent the grip's removal. In one embodiment, the abutment surface 131 of the grip 60 may be formed on a bottom end of locking rail 64. In other embodiments, the abutment surface 131 may be formed on the grip 60 separately from the locking rail 64.

Various portions of or the entire grip frame 22 and grip 60 may be formed of any suitable material or combination of materials including metals and non-metals. Exemplary, but non-limiting non-metals may include glass or nylon reinforced and unreinforced polymers, fiberglass, graphite composite materials, and others. In one non-limiting embodiment, the grip and grip frame may be made of a reinforced or unreinforced polymer.

For reasons including ease of manufacture, the grip mounting rails 71 and locking rail 64 may be formed on a separate prefabricated grip insert 112 which is attached to the body of the grip 60 (see, e.g. FIGS. 5-8). The alignment rail 132, cam operating aperture 135, and cantilevered detent arm 110 may further be formed as part of the grip insert 112. The grip insert 112 may be molded or cast incorporating the foregoing features. In embodiments where the grip insert 112 and grip 60 body may be formed of polymer, the grip body may be overmolded onto the grip insert to embed and incorporate the grip insert into the grip structure. The grip insert 112 may be attached to the grip body using other fabrication techniques, including for example without limitation mechanical fasteners, welding, soldering, and/or adhesives. In some embodiments, the grip insert 112 may be a metal part with the grip 60 body being overmolded around the insert to embed the insert therein.

Figure 4:
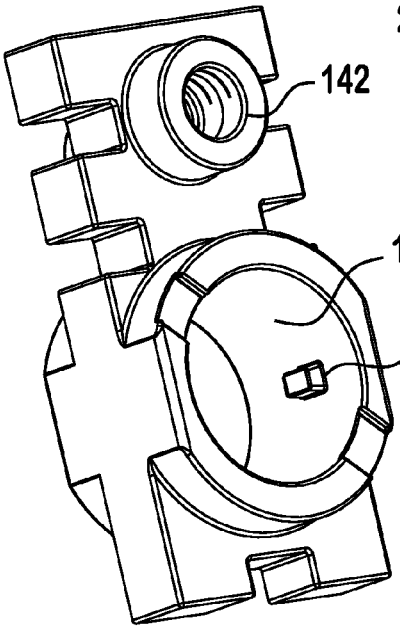
FIG. 4 is a perspective view of a grip frame insert mountable in the grip frame.
Figure 6:
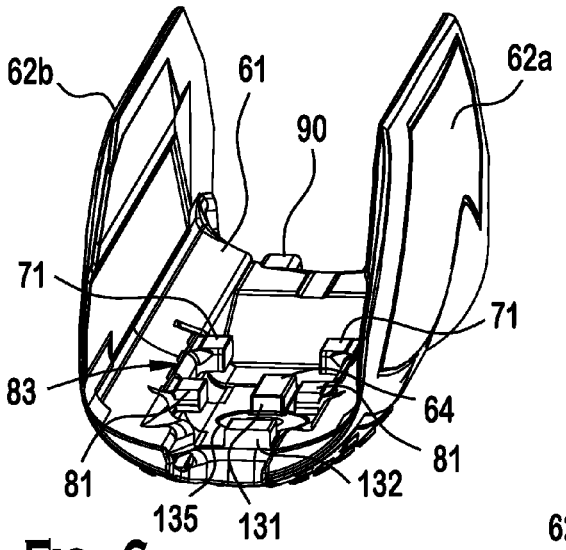
FIGS. 5-7 are perspective and plan views of the grip showing the interior.

The cam receptacle 102 may also be formed on a separate prefabricated grip frame insert 140 which is attached to the grip frame body. Referring to FIGS. 3, 4, and 11, insert 140 may include an alignment hole 142 to facilitate axially aligning the alignment mark 107 on locking cam 100 for assembling the cam in the receptacle 102. In one embodiment, the grip frame insert 140 and locking cam 100 may each be formed of metal such as without limitation steel to provide a structurally robust and wear-resistant locking mechanism. In other embodiments, the grip frame insert and cam may each be formed of a non-metallic material such as polymer. Preferably, the material used for the grip frame insert 140 and locking cam 100 have a substantially compatible and comparable hardness (e.g. metal and metal, or polymer and polymer) so that one component does not prematurely wear the other when locking or unlocking the grip from the grip frame over time. The grip frame insert 140, whether made of metal or polymer, may be over-molded with the grip frame 22. It will be appreciated that in other embodiments the cam receptacle 102 may be molded as a unitary structural part of a one-piece grip frame during the molding process where the receptacle is to made of the same material (i.e. polymer) as the grip frame without the use of an insert.

An exemplary method for mounting a replaceable grip on a firearm will now be described with reference to FIGS. 11-33. FIGS. 11-16 show the assembly position of the locking cam 100. FIGS. 17-25 show the unlocked position of the locking cam 100 and grip 60. FIGS. 26-33 show the locked position of the locking cam 100 and grip 60.

In general, the method includes first providing the pistol 20 which includes the foregoing grip frame 22 with the present camlock mechanism and a grip 60. The locking cam 100 has been inserted into cam receptacle 102 (see FIGS. 11-16) and mounted on the grip frame 22. The locking cam 100 has been rotated (clockwise in the figures) to the initial recessed and unlocked rotational position which allows the locking rail 64 to pass over the blocking surface 130 of the cam (see, e.g. FIGS. 17-25) The locking protrusion 124 in cam receptacle 102 is positioned in the first locked end 121 of the cam track 120. In embodiments, where two cam tracks 120 are provided as shown, each locking protrusion 124 is positioned in the locked end of their respective track.

The grip 60 is then positioned behind the rear wall 25 of grip frame 22 and moved forward in a horizontal direction generally non-parallel and transverse to the grip mounting axis GA of the grip frame 22 (along transverse axis TA) to abut the grip with the rear wall of the grip frame. The rear wall 25 and at least portions of the sidewalls 26*a*, 26*b* of the grip frame 22 are concomitantly received in the forwardly open cavity 63 of the grip 60. Preferably, the mounting rails 71, 81 and locking rail 64 of the grip are initially positioned vertically below the lower entrances (i.e. open bottom ends) of the mating mounting slots 70, 80 and locking slot 65 of the grip frame 22. The top mounting rails 71 have a length sized less than the vertical dimension of the rail entrance 82 between the raised protrusions 73, 143 to allow insertion of rails 71 through the entrance and against the rear wall 25 of grip frame 22. This axially aligns the mounting rails 71, 81 with their respective mounting slots 70, 80.

While holding the grip 60 pressed against the rear of the grip frame 22, the grip is next slid axially upwards parallel and substantially along the grip mounting axis GA of the grip frame. This moves the mounting rails 71, 81 on the grip into and engages the mounting slots 70, 80 of the grip frame (see, e.g. FIGS. 30 and 32). The locking rails 71, 81 of the grip 60 simultaneously enters and engages the locking slots 70, 80 of the grip frame 22. The grip 60 is preferably raised vertically along the grip frame 22 until the pair of top mounting tabs 90 are slideably and insertably received in the mating pair of tab pockets 91 formed in the grip frame. This positioning also ensures that the pairs of mounting rails 71, 81 and locking rail 64 of the grip 60 are fully inserted into their mating mounting slots 70, 80 and locking slot 65 of the grip frame 22. The grip 60 is now in a fully mounted, but yet unlocked to the grip frame. It should be noted that the grip 60 cannot be horizontally removed rearward from the grip frame 22 (transverse to the grip mounting axis GA and grip rear wall 25) due to the interlock formed between the mating mounting rails and slots.

Figure 29:
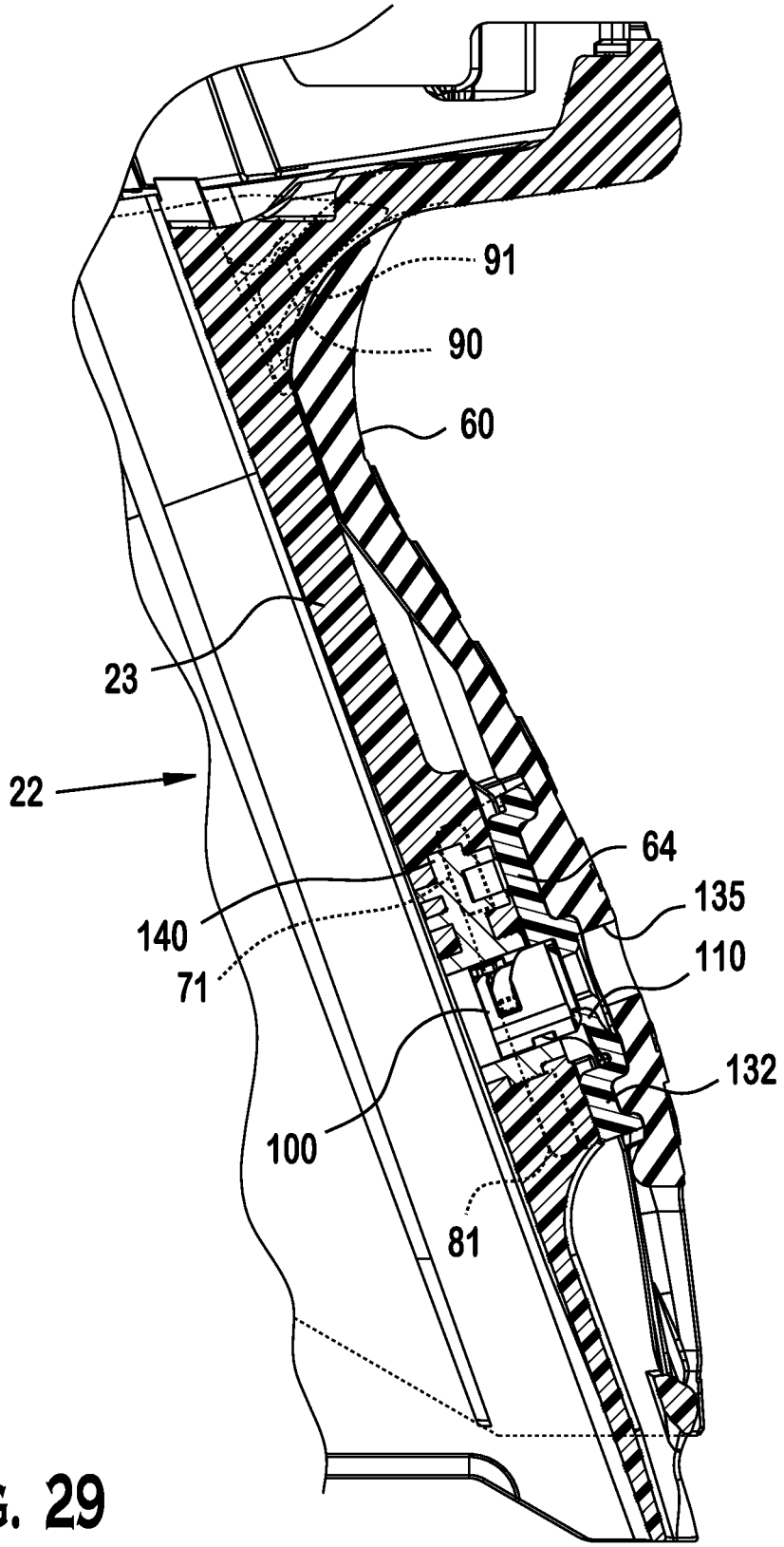
FIG. 29 is a side cross-sectional view thereof showing the grip locking rail positioned above the locking cam wherein the axial removal path of the locking rail is blocked.
Figure 29A:
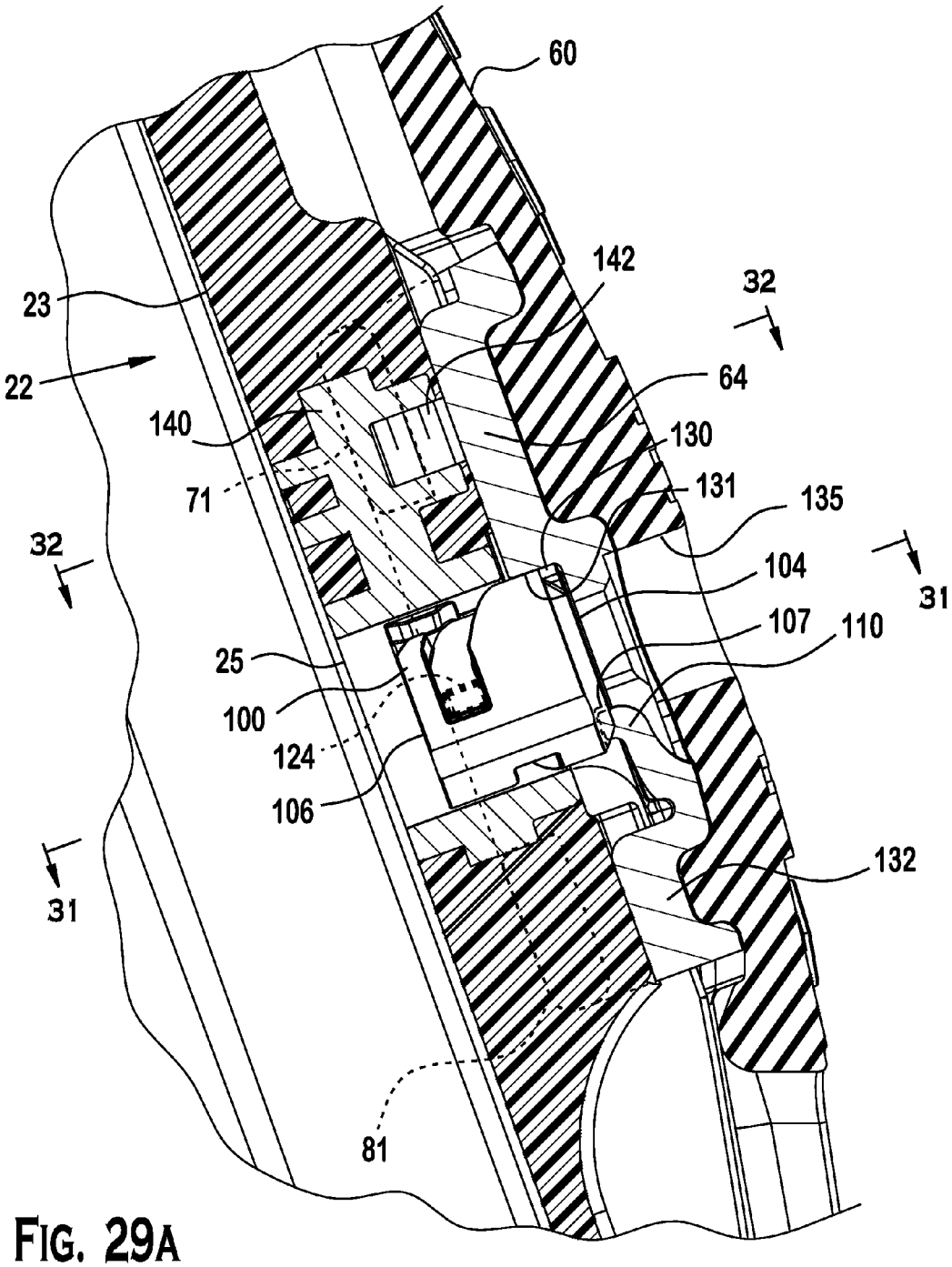
FIG. 29A is an enlarged detail from FIG. 29 showing the locking cam region.
Figure 30:
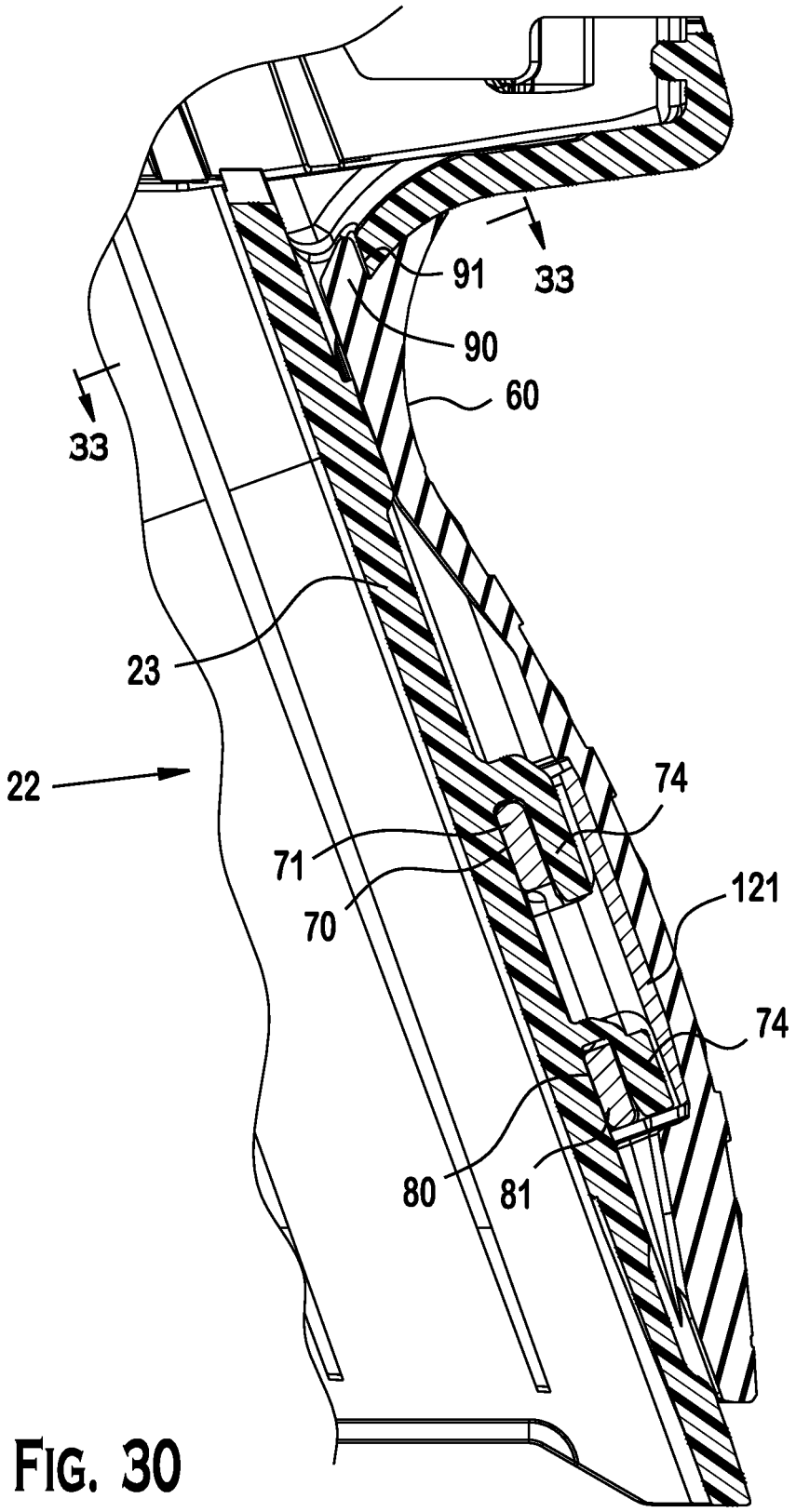
FIG. 30 is an additional side cross-sectional view thereof showing mounting rails of the grip slideably inserted into the mating mounting slots in the grip frame.
Figure 31:
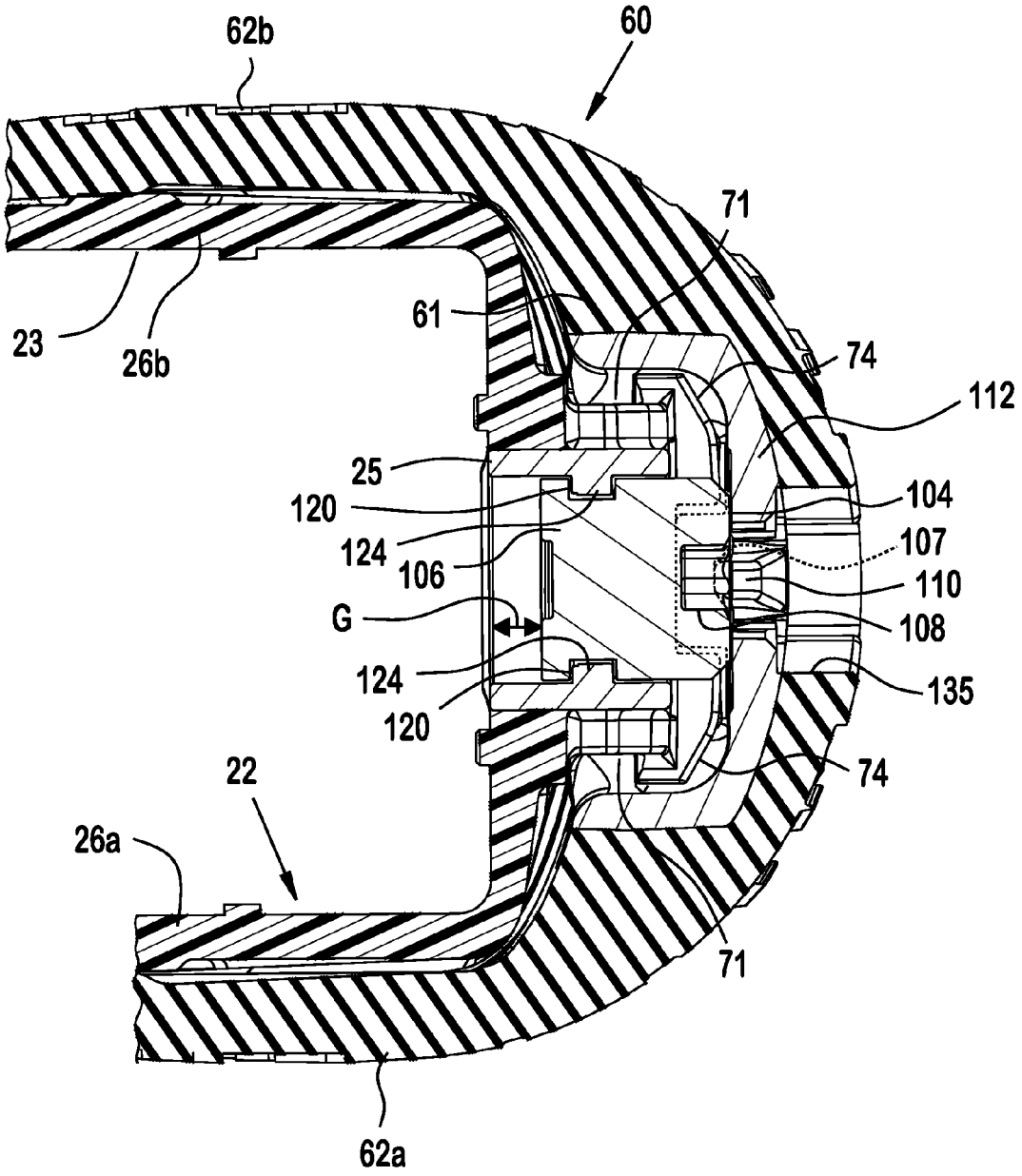
FIG. 31 is a top cross-sectional view thereof showing the locking cam in the projected locked and blocking position.
Figure 32:
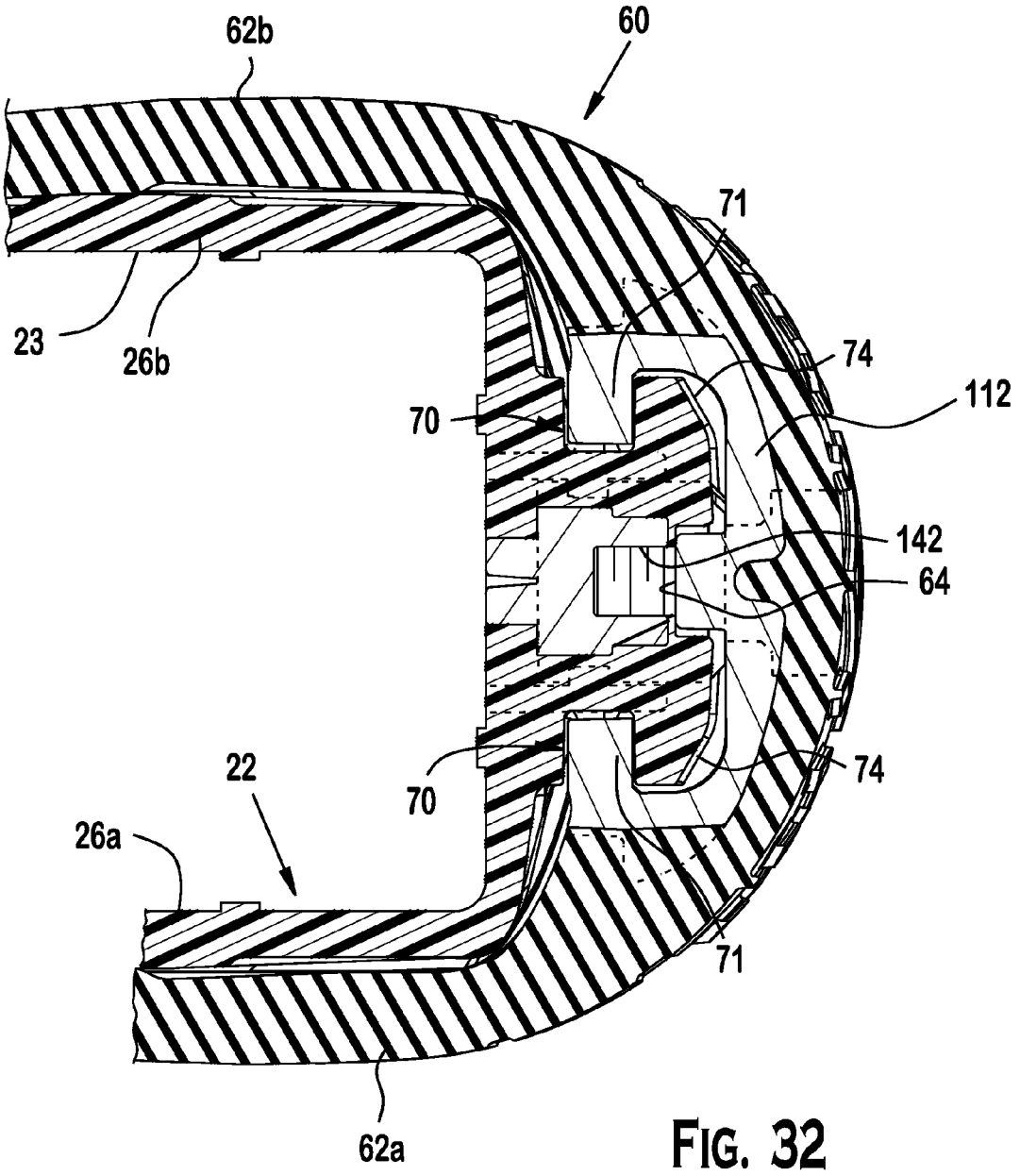
FIG. 32 is an additional top cross-sectional view thereof showing the mounting rails of the grip inserted into the mating mounting slots of the grip frame.
Figure 33:
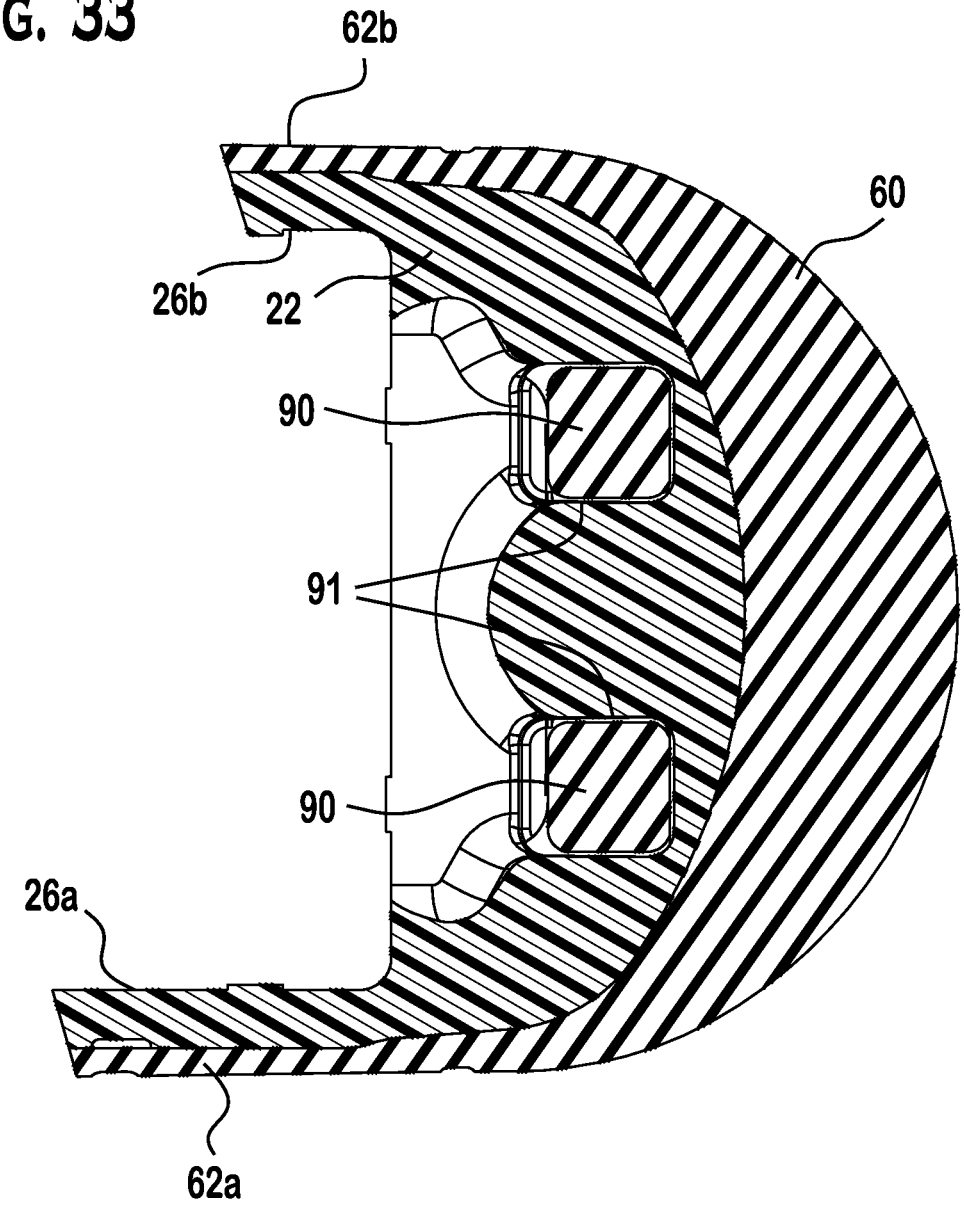
FIG. 33 is a top cross-sectional view thereof showing the grip top mounting tabs inserted in the mating mounting pockets of the grip frame.

After the grip 60 is in the foregoing fully mounted position, the locking cam 100 is rotated using an appropriate configured key or tool to move the locking protrusion 124 of the cam receptacle 102 from the unlocked end 121 of the cam track 120 to the opposite locked end 122 (see, e.g. FIGS. 26-29) If two cam tracks 120 are provided, as shown, each locking protrusion 124 moves from its respective unlocked to lock end of the track. This rotational movement creates an outward linear travel of the cam 100 from the grip frame 22 along the cam receptacle centerline CL2 to move the locking cam from the recessed unlocked position (FIG. 23) to the projected locked position (FIG. 27). This is evident in FIGS. 29 and 31 show a gap G formed between the bottom surface 106 of locking cam 100 and rear wall 25 of grip frame 22. The blocking surface 130 on the top portion of the cam 100 now is positioned in and blocks the axial travel pathway of abutment surface 131 on the grip locking rail 64 (oriented parallel to the mounting axis of the grip frame) so that the locking rail cannot be slideably withdrawn from the locking slot 65. This also prevents the mounting rails 71, 81 from being withdrawn from their corresponding mounting slots 70, 80. The mounting and locking rails of the grip are therefore trapped in their respective mounting and locking slots of the grip frame. The locking cam 100 has now been rotated to the locked position which prevents removal of the grip from the grip frame of the pistol. FIGS. 26-33 show the locked position of the rotary cam mechanism.

It bears noting that rotating the cam 100 to the locked position also resiliently engages the hooked end 110*a* of locking cantilevered detent arm 110 with detent pocket 109 of the cam. Advantageously, this maintains the locked position of the cam 100 and prevents rotation to the unlocked position that might be caused by vibrations created by recoil forces from firing the pistol 20.

To remove the grip 60 from the grip frame 22, the foregoing mounting process is reversed. This permits removal of the first grip 60 and replacement with a second grip which may have at least one feature different than the first grip such as without limitation size, shape, material, and/or surface textures. Advantageously, this permits the pistol user to change grips easily to suit changing grip preferences and/or environmental conditions.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with replaceable grip comprising:

a grip frame defining a grip mounting axis;

a grip configured for mounting on the grip frame; and a rotary camlock mechanism configured and operable to lock and unlock the grip from the grip frame, the camlock mechanism rotationally movable between a first locked position preventing removal of the grip from the grip frame and a second unlocked position allowing removal of the grip from the grip frame;

wherein the camlock mechanism comprises a rotatable locking cam rotatably mounted in the grip frame, the locking cam configured and positioned to engage the grip when the camlock mechanism is the locked position and to disengage the grip when the camlock mechanism is in the unlocked position;

wherein the locking cam is movably received in a rearwardly open circular receptacle formed in the grip frame.

2. The firearm according to claim 1, wherein the camlock mechanism includes a blocking surface moveable into and out of engagement with an abutment surface on the grip to prevent removal of the grip from the grip frame.

3. The firearm according to claim 1, wherein the locking cam is configured so that rotating the locking cam in opposing directions linearly moves the locking cam transversely to the grip mounting axis to selectively engage or disengage the grip.

4. The firearm according to claim 3, wherein the locking cam includes an inclined cam track that converts rotary motion of the locking cam into the transverse linear motion.

5. The firearm according to claim 4, wherein the grip frame includes a cam protrusion which slides in the cam track configured to create the transverse linear motion when the locking cam is rotated.

6. The firearm according to claim 1, wherein the locking cam is cylindrical in shape.

7. The firearm according to claim 1, wherein the locking cam defines a blocking surface that is movable into and out of the receptacle by rotating the locking cam, the blocking surface projected outward from the receptacle to engage an abutment surface on the grip when the camlock mechanism is in the locked position, and the blocking surface retracted inside the receptacle when the camlock mechanism is in the unlocked position to allow removal of the grip from the grip frame.

8. The firearm according to claim 1, further comprising a first pair of guide slots formed on the grip frame which slideably receive a first pair of guide rails formed on the grip, wherein the grip cannot be removed from grip frame in a direction transverse to the grip axis when the rails are in the slots.

9. The firearm according to claim 8, wherein the guide slots of the first pair are laterally spaced apart and the guide slots of the second pair are laterally spaced apart.

10. The firearm according to claim 1, further comprising a second pair of guide slots formed on the grip frame which are axially spaced apart from the first pair of guide slots along the grip axis, and a second pair of guide rails formed on the grip which are axially spaced apart from the first pair of guide rails, the second pair of guide slots configured to slideably receive the second pair of guide rails.

11. The firearm according to claim 1, further comprising the grip includes a pair of tabs formed proximate to a top end of the grip which are slideably received in a mating pair of pockets formed proximate to a rear end of the grip frame.

12. A firearm with replaceable grip system comprising:

a grip frame defining a grip mounting axis;

a grip removably mounted on the grip frame;

an abutment surface formed on the grip;

a rotary locking cam rotatably received in a complementary configured rearwardly open circular receptacle in the grip frame, the locking cam including a blocking surface movable between a projecting locked position and a retracted unlocked position;

the locking cam including an inclined cam track configured to engage the grip frame for converting rotational movement of the locking cam into linear movement with respect to the receptacle;

wherein rotating the locking cam in a first direction moves the blocking surface into alignment with the abutment surface forming the locked position that prevents removal of the grip from the grip frame, and rotating the locking cam in a second direction removes the blocking surface from alignment with the abutment surface forming the unlocked position that allows removal of the grip from the grip frame.

13. The firearm according to claim 12, wherein the blocking surface of the locking cam protrudes outwards from the receptacle to engage the abutment surface of the grip in the locked position, and wherein the blocking surface retreats into the receptacle to disengage the abutment surface in the unlocked position.

14. The firearm according to claim 12, wherein the locking cam has a cylindrical shape and the cam track is arcuately formed on an outer circumference of the locking cam.

15. The firearm according to claim 12, wherein the grip includes a resilient locking cantilever arm engageable with a detent pocket formed on the locking cam, the locking arm configured to retain the blocking surface of locking cam in the locked position.

16. The firearm according to claim 12, wherein the abutment surface of the grip is positioned above the locking cam when the locking cam is in the locked position.

17. The firearm according to claim 12, wherein the grip includes a cam operating aperture that is axially aligned with the receptacle of the grip frame when the grip is fully mounted on the firearm for operating the locking cam.

18. The firearm according to claim 12, wherein the receptacle is formed on a metal insert mounted on the grip frame and the locking cam is also formed of metal.

19. The firearm according to claim 12, wherein the grip is U-shaped in cross section.

20. A method for mounting a replaceable grip on a firearm, the method comprising:

providing a grip frame including a grip mounting axis and a rotary locking cam rotated to an unlocked position;

providing a grip including an abutment surface;

positioning the grip on the grip frame in a removal position wherein the abutment surface is located in a first axial position along the grip mounting axis;

sliding the grip on the grip frame to a mounting position wherein the abutment surface is located in a second axial position along the grip mounting axis; and rotating the locking cam from the unlocked position to a locked position thereby moving a blocking surface on the locking cam into axial alignment with the abutment surface of the grip between the first and second axial positions;

wherein the grip is not removable from the grip frame when the locking cam is in the locked position;

wherein the locking cam is movably received in a rearwardly open circular receptacle formed in the grip frame.

21. The method according to claim 20, further comprising a camtrack configured to convert rotational motion of the locking cam during the rotating step into linear displacement of the locking cam transverse to the grip mounting axis.

22. The method according to claim 20, wherein the sliding step further includes slideably inserting a pair of guide rails on the grip into a mating pair of guide slots on the grip frame, the guide slots configured to engage the guide rails preventing removal of the grip from the grip frame in a transverse direction to the grip axis.

* * * * *